US011205318B2

(12) United States Patent
Hendricks et al.

(10) Patent No.: US 11,205,318 B2
(45) Date of Patent: Dec. 21, 2021

(54) SHIFTING SIDE REELS INTO REEL AREA FOR ELECTRONIC GAMING DEVICE

(71) Applicant: Aristocrat Technologies Australia Pty Limited, North Ryde (AU)

(72) Inventors: Bradley Hendricks, Las Vegas, NV (US); Damien Burczyk, Henderson, NV (US); Joseph Masinter, Las Vegas, NV (US); Amy Bruderer, Pahrump, NV (US); Andrew Harrington, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

(21) Appl. No.: 16/528,407

(22) Filed: Jul. 31, 2019

(65) Prior Publication Data

US 2020/0098221 A1 Mar. 26, 2020

Related U.S. Application Data

(60) Provisional application No. 62/734,215, filed on Sep. 20, 2018.

(51) Int. Cl.
*G07F 17/34* (2006.01)
*G07F 17/32* (2006.01)

(52) U.S. Cl.
CPC ..... *G07F 17/3213* (2013.01); *G07F 17/34* (2013.01)

(58) Field of Classification Search
CPC ..... G07F 17/3213; G07F 17/34
See application file for complete search history.

(56) References Cited

U.S. PATENT DOCUMENTS

| | | | | |
|---|---|---|---|---|
| 6,048,269 | A | 4/2000 | Burns | |
| 6,142,876 | A | 11/2000 | Cumbers | |
| 6,685,567 | B2 | 2/2004 | Cockerille | |
| 8,932,129 | B2 | 1/2015 | Powell | |
| 2006/0287077 | A1 | 12/2006 | Grav | |
| 2007/0026935 | A1 | 2/2007 | Wolf | |
| 2009/0054139 | A1 | 2/2009 | Anderson | |
| 2015/0348374 | A1* | 12/2015 | Dupuis | G07F 17/3213 463/20 |
| 2016/0217646 | A1* | 7/2016 | Hornik | G07F 17/34 |

FOREIGN PATENT DOCUMENTS

WO 2005026909 3/2005

* cited by examiner

*Primary Examiner* — Corbett B Coburn
(74) *Attorney, Agent, or Firm* — Klarquist Sparkman, LLP

(57) ABSTRACT

Innovations in user interface ("UI") features of an electronic gaming device, and in features of backend processing to implement the UI features, are presented. For example, control logic selects active reels, which include side reels and main reels. Compared to the main reels, the side reels typically include symbols of greater interest to a user. The control logic also selects a subset of the active reels. The control logic spins at least some of the active reels on a display screen of the device. The control logic shifts some active reels into a reel area while shifting other active reels out of the reel area, before stopping at the subset of the active reels. Reel shifting can increase game volatility while maintaining a designated level of return to player. At the same time, by selecting side reels and reels within the reel area when shifting stops, outcomes can satisfy regulations.

20 Claims, 24 Drawing Sheets

501

UI system:

502 backend system:

FIG. 7

700

```
<?xml version="1.0" encoding="utf-8"?>
<weighttables version="1.00" xmlns="http://aristocrat-inc.com/WeightTable.xsd">

  <!-- FuryRoad Feature -->
  <weighttable name="FuryRoadTriggered" type="bool">
    <weightentry count="1"  value="true"/>
    <weightentry count="364" value="false"/>
  </weighttable>
```

710

711 712

```
  <!-- FuryRoadReels -->
  <weighttable name="FuryRoadReels" type="string">
    <!-- Left and Right Fury Road Reels (10 total), Final Landing Position,
Max Left Turn Depth, Max Right Turn Depth-->
    <weightentry count="19875" value="WI WI WI WI WI WI WI WI WI WI L1 3 3"/>
    <weightentry count="24682" value="WI WI WI X2 WI WI WI WI WI WI L1 3 3"/>
    <weightentry count="10526" value="WI WI WI X3 WI WI WI WI WI WI L1 3 3"/>
    <weightentry count="68547" value="WI WI WI X4 WI WI WI WI WI WI L1 3 3"/>
    <weightentry count="32048" value="WI WI WI P1 WI WI WI WI WI WI L1 3 3"/>
    <weightentry count="6875" value="WI WI WI P2 WI WI WI WI WI WI L1 3 3"/>
    <weightentry count="6354" value="WI WI X2 WI WI WI WI P2 WI WI R5 5 5"/>
    <weightentry count="9879" value="WI WI X3 WI WI WI WI P2 WI WI R5 5 5"/>
    <weightentry count="654" value="WI WI X4 WI WI WI WI P2 WI WI R5 5 5"/>
    <weightentry count="546" value="WI WI P1 WI WI WI WI P2 WI WI R5 5 5"/>
    <weightentry count="456" value="WI WI P2 WI WI WI WI P2 WI WI R5 5 5"/>
  </weighttable>
```

720

721 722

```
</weighttables>
```

starting position of active reels:

active reels gradually shift left; right-side reel(s) shifting in from right; main reel(s) shifting out to left):

active reels gradually shift left; right-side reel(s) shifting in from right; main reel(s) shifting out to left):

active reels gradually shift right; right-side reel(s) shifting out to right; main reel(s) shifting in from left):

active reels gradually shift right; right-side reel(s) shifting out to right; main reel(s) shifting in from left):

active reels gradually shift right; left-side reel(s) shifting in from left; main reel(s) shifting out to right):

active reels gradually shift right; left-side reel(s) shifting in from left; main reel(s) shifting out to right):

active reels gradually shift left; left-side reel(s) shifting out to left; main reel(s) shifting in from right):

active reels gradually shift left; left-side reel(s) shifting out to left; main reel(s) shifting in from right):

active reels gradually shift left; right-side reel(s) shifting in from right; main reel(s) shifting out to left):

active reels gradually shift right; right-side reel(s) shifting out to right; main reel(s) shifting in from left):

active reels gradually shift right; left-side reel(s) shifting in from left; main reel(s) shifting out to right):

stopping position of active reels:

900

SHIFTING SIDE REELS INTO REEL AREA FOR ELECTRONIC GAMING DEVICE

CROSS REFERENCE TO RELATED APPLICATION

This patent application claims the benefit of U.S. Provisional Patent Application No. 62/734,215, filed Sep. 20, 2018, the disclosure of which is hereby incorporated by reference.

TECHNICAL FIELD

User interface ("UI") features of electronic gaming devices are described herein, along with features of backend processing to implement the UI features. For example, processes for electronic gaming machines ("EGMs") that shift side reels into and out of a reel area are described.

BACKGROUND

EGMs provide a variety of wagering games such as slot games, video poker games, video blackjack games, roulette games, video bingo games, keno games and other types of games, which are frequently offered at casinos and other locations for use by players. Play on an EGM typically involves a player establishing a credit balance by inputting money, or another form of monetary credit, and placing a wager (from the credit balance) on one or more outcomes of an instance (or single play) of a primary or base game. In some cases, a player may qualify for a special mode of the base game, a secondary game, or a bonus round of the base game by attaining a certain winning combination or triggering event in, or related to, the base game, or after the player is randomly awarded the special mode, secondary game, or bonus round. In the special mode, secondary game, or bonus round, the player is given an opportunity to win extra game credits, game tokens or other forms of payout. In the case of "game credits" that are awarded during play, the game credits are typically added to a credit meter total on the EGM and can be provided to the player upon completion of a gaming session or when the player wants to "cash out."

A "slot" type game is often presented to a player in the form of various symbols arrayed in a row-by-column grid (matrix). Specific matching combinations of symbols along predetermined paths (or "pay lines") through the matrix indicate the outcome of the game. The display typically highlights winning combinations/outcomes for ready identification by the player. Matching combinations and their corresponding awards are usually shown in a "pay table," which is available to the player for reference. Often, the player may vary his/her wager to include differing numbers of pay lines and/or the amount bet on each line. By varying the wager, the player may sometimes alter the frequency or number of winning combinations, frequency or number of secondary games, and/or the amount awarded.

Typically, a game uses a random number generator ("RNG") to randomly determine the outcome of the game. A game is designed to return a certain percentage of the amount wagered back to a player over the course of many plays or instances of the game, which is generally referred to as return to player ("RTP"). The RTP and randomness of the RNG ensure the fairness of games and are highly regulated. For example, upon initiation of play, an RNG may randomly determine a game outcome, and symbols are selected which correspond to that outcome. Notably, some games may include an element of skill on the part of the player and are therefore not entirely random.

EGMs depend on usability to enhance the user experience and extend player time on the EGMs. Although previous EGMs include various UI features, and backend operations associated with the UI features, that improve usability and enhance the user experience, there is room for further improvement to EGMs.

SUMMARY

In summary, the detailed description presents innovations in user interface ("UI") features of electronic gaming devices, as well as innovations in features of backend processing to implement the UI features. For example, the detailed description presents processes for electronic gaming machines ("EGMs") that shift side reels into and out of a reel area. In some example implementations, the innovations improve usability of the EGMs by enhancing the user experience, extending player time on the EGMs, and maintaining the interest of current users in the EGMs.

For example, according to a first set of innovations described herein, control logic is configured to perform UI-focused operations to control the UI of an electronic gaming device. The UI-focused operations include spinning at least some of a set of active reels on a display screen of the electronic gaming device. Each of the active reels has an associated reel strip that, upon a spin of the reel, is movable through a reel area on the display screen of the electronic gaming device. The active reels include one or more main reels and one or more side reels. The UI-focused operations further include shifting at least some of the active reels into the reel area while shifting at least some of the active reels out of the reel area, before stopping at a subset of the active reels. Finally, the UI-focused operations include, after stopping at the subset of the active reels, outputting an indication of an outcome. In some example implementations, side reels shift into and out of a reel area in a base reel game or bonus reel game. Typically, the side reels include symbols of greater interest to a user due to their enhanced value when calculating win conditions on pay lines (e.g., wild symbols, multiplier symbols, special character symbols). As such, shifting side reels into and out of the reel area can achieve a target level of game volatility while maintaining a designated level of return to player ("RTP").

As another example, according to a second set of innovations described herein, control logic is configured to perform backend operations to control the UI of an electronic gaming device. The backend operations include selecting a set of active reels for a process (e.g., mode of a base reel game or bonus reel game) that includes spinning at least some of the set of active reels on a display screen of the electronic gaming device. Each of the active reels has an associated reel strip that, upon a spin of the reel, is movable through a reel area on the display screen of the electronic gaming device. The active reels include one or more main reels and one or more side reels. The backend operations further include selecting a subset of the active reels for the process, which further includes shifting at least some of the active reels into the reel area while shifting at least some of the active reels out of the reel area, before stopping at the subset of the active reels. Finally, the backend operations include determining an outcome of the process. In some example implementations, side reels shift into and out of a reel area in a base reel game or bonus reel game. By selecting which side reels can be shifted into/out of the reel area, and by selecting which reels are within the reel area when the shifting stops, game play can be kept fair and consistent with regulations while also providing variety that achieves a target level of game volatility for a designated level of RTP.

The innovations can be implemented as part of a method, as part of an electronic gaming device such as an EGM or electronic gaming server configured to perform the method, or as part of non-transitory computer-readable media storing computer-executable instructions for causing one or more processors in a computer system to perform the method. The various innovations can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the invention will become more apparent from the following detailed description, which proceeds with reference to the accompanying figures and illustrates a number of examples. Examples may also be capable of other and different applications, and some details may be modified in various respects all without departing from the spirit and scope of the disclosed innovations.

BRIEF DESCRIPTION OF THE DRAWINGS

The following drawings illustrate some features of the disclosed innovations. The drawings are not necessarily drawn to scale.

FIG. 7 is a code listing illustrating two example weighted tables in accordance with some embodiments.

FIGS. 8*a*-8*m* are representations of example screen shots of a display screen of an EGM for a special mode of a reel game, according to some example implementations.

DETAILED DESCRIPTION

The detailed description presents innovations in user interface ("UI") features of electronic gaming devices, as well as innovations in features of backend processing to implement the UI features. For example, processes for electronic gaming machines ("EGMs") that shift side reels into and out of a reel area are described. In example implementations, control logic controls the UI of an EGM, shifting side reels into and out of a reel area in a base reel game or bonus reel game, which is an example of a process. Typically, the side reels that are potentially shifted into the reel area include symbols of greater interest to a user due to their enhanced value when calculating win conditions on pay lines (e.g., wild symbols, multiplier symbols, special character symbols). As such, shifting side reels into and out of the reel area can achieve a desired game volatility (e.g., increase game volatility) while maintaining a designated level of RTP. Furthermore, by selecting which side reels can be shifted into/out of the reel area, and by selecting which reels are within the reel area when the shifting stops, game play can be kept fair and consistent with regulations while also enabling variation of game volatility for a designated level of RTP.

In the examples described herein, identical reference numbers in different figures indicate an identical component, module, or operation. More generally, various alternatives to the examples described herein are possible. For example, some of the methods described herein can be altered by changing the ordering of the method acts described, by splitting, repeating, or omitting certain method acts, etc. The various aspects of the disclosed technology can be used in combination or separately. Some of the innovations described herein address one or more of the problems noted in the background. Typically, a given technique/tool does not solve all such problems. It is to be understood that other examples may be utilized and that structural, logical, software, hardware, and electrical changes may be made without departing from the scope of the disclosure. The following description is, therefore, not to be taken in a limited sense. Rather, the scope of the present disclosure is defined by the appended claims.

I. Example Electronic Gaming Servers and Electronic Gaming Machines.

Figure 1:
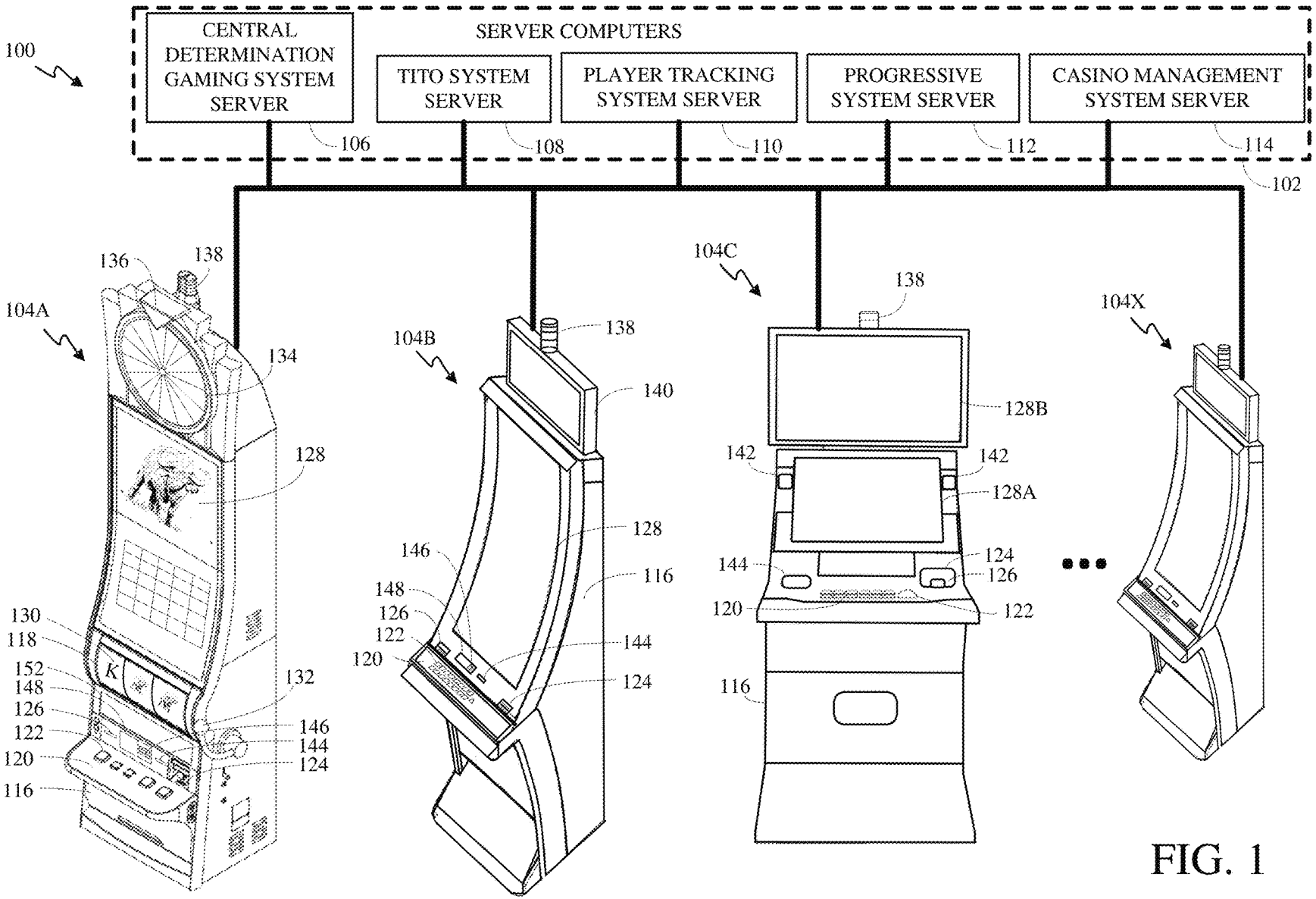
FIG. 1 is a perspective diagram of example EGMs according to some embodiments.

FIG. 1 illustrates several different models of EGMs which may be networked to various gaming-related servers. Shown is a system 100 in a gaming environment including one or more server computers 102 (e.g., slot servers of a casino) that are in communication, via a communications network, with one or more gaming devices 104A-104X that have communication interfaces with the network. The server computers 102 and/or gaming devices 104A-104X can implement one or more aspects of the present disclosure.

The gaming devices 104A-104X may be EGMs such as slot machines, video poker machines, bingo machines, etc. The gaming devices 104A-104X may alternatively be portable and/or remote gaming devices such as, but not limited to, a smartphone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a website maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency ("RF") (e.g., wireless fidelity (WiFi®) and Bluetooth®), cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. In this case, functions normally performed by a server computer or data normally stored on a server computer may instead be performed by or stored on a gaming device. The stand-alone gaming device may be in communication with one or more other gaming devices (but not a server computer). However, it is typical to find multiple EGMs connected to networks implemented with one or more of the different server computers 102 described herein.

A. Example Server Computers.

Server computers 102 can include one or more servers that combine to form a casino management system, which manages one or more gaming devices 104A-X. Each of the servers includes at least one processor, memory, and a network interface, which enables communication over one or more networks between the server computers 102 and the gaming devices 104A-X. In general, the casino management system is configured to receive gaming data from the gaming devices 104A-X as the gaming devices 104A-X conduct rounds of play of one or more wagering games.

As shown in FIG. 1, the server computers 102 may include a central determination gaming system server 106 (also called a gaming server), a ticket-in-ticket-out ("TITO") system server 108, a player tracking system server 110, a progressive system server 112, and/or a casino management system server 114. Gaming devices 104A-104X may include features to enable operation of any or all server computers 102 for use by the player and/or operator (e.g., the casino, resort, gaming establishment, tavern, pub, etc.). For example, game outcomes may be generated on a central determination gaming system server 106 and then transmitted over a network to any of a group of remote terminals or remote gaming devices 104A-104X that utilize the game outcomes and display the results to the players.

FIG. 1 shows different servers that perform different sets of functions. Alternatively, one or more of the different servers shown in FIG. 1 can be combined.

B. Example Gaming Devices.

Still referring to FIG. 1, the gaming devices 104A-C illustrated are specific exemplary embodiments of EGMs, and the same or similar elements shown in gaming devices 104A-C may be included in any gaming device 104X. More generally, an EGM may be any type of gaming machine and may include, without limitation, different structures than those shown in FIG. 1. A gaming device may use specially-configured computer hardware that implements game functionality, or a gaming device may use general-purpose computer hardware that has been programmed to implement game functionality. For example, an EGM can be implemented using a personal computer, tablet computer, smartphone, personal digital assistant, or any other computing device.

Gaming device 104A is often of a cabinet construction which may be aligned in rows or banks of similar devices for placement and operation on a casino floor. The gaming device 104A often includes a main door which provides access to the interior of the cabinet 116. Gaming device 104A typically includes a button area or button deck 120 accessible by a player that is configured with input switches or buttons 122, an access channel for a bill validator 124, and/or an access channel for a ticket-out printer 126. The input switches or buttons 122, along with other input devices, provide at least part of a player interface through which a player controls operation of a game. For example, buttons 122 may be used to start play of a primary game or secondary game. Alternatively, instead of having separate buttons that can be actuated physically, one or more of the buttons 122 can be presented on a touchscreen.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube ("CRT"), or other conventional electronically controlled video monitor. Alternatively, the main display 128 can be a touchscreen display. The main display 128 is an interface component used to play a game on the gaming device 104A.

In some embodiments, the bill validator 124 may also function as a "ticket-in" reader that allows the player to use a casino issued credit ticket to load credits onto the gaming device 104A (e.g., in a cashless ticket (TITO) system). In such cashless embodiments, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A. The gaming machine 104A can have hardware meters for purposes including ensuring regulatory compliance and monitoring the player credit balance. In addition, there can be additional meters that record the total amount of money wagered on the gaming machine, total amount of money deposited, total amount of money withdrawn, total amount of winnings on gaming device 104A.

In some embodiments, a player tracking card reader 144, a transceiver for wireless communication with a mobile device (e.g., a player's smartphone), a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152, which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116, which may be used to initiate game play. In general, a "handle pull" or "spin" of a game may refer to a single play at a gaming device, whether or not a handle is involved in the play, and whether or not a handle is even included in the gaming device. Thus, a play can be initiated by a press of a physical or virtual button, or via another activation mechanism.

Figure 2:
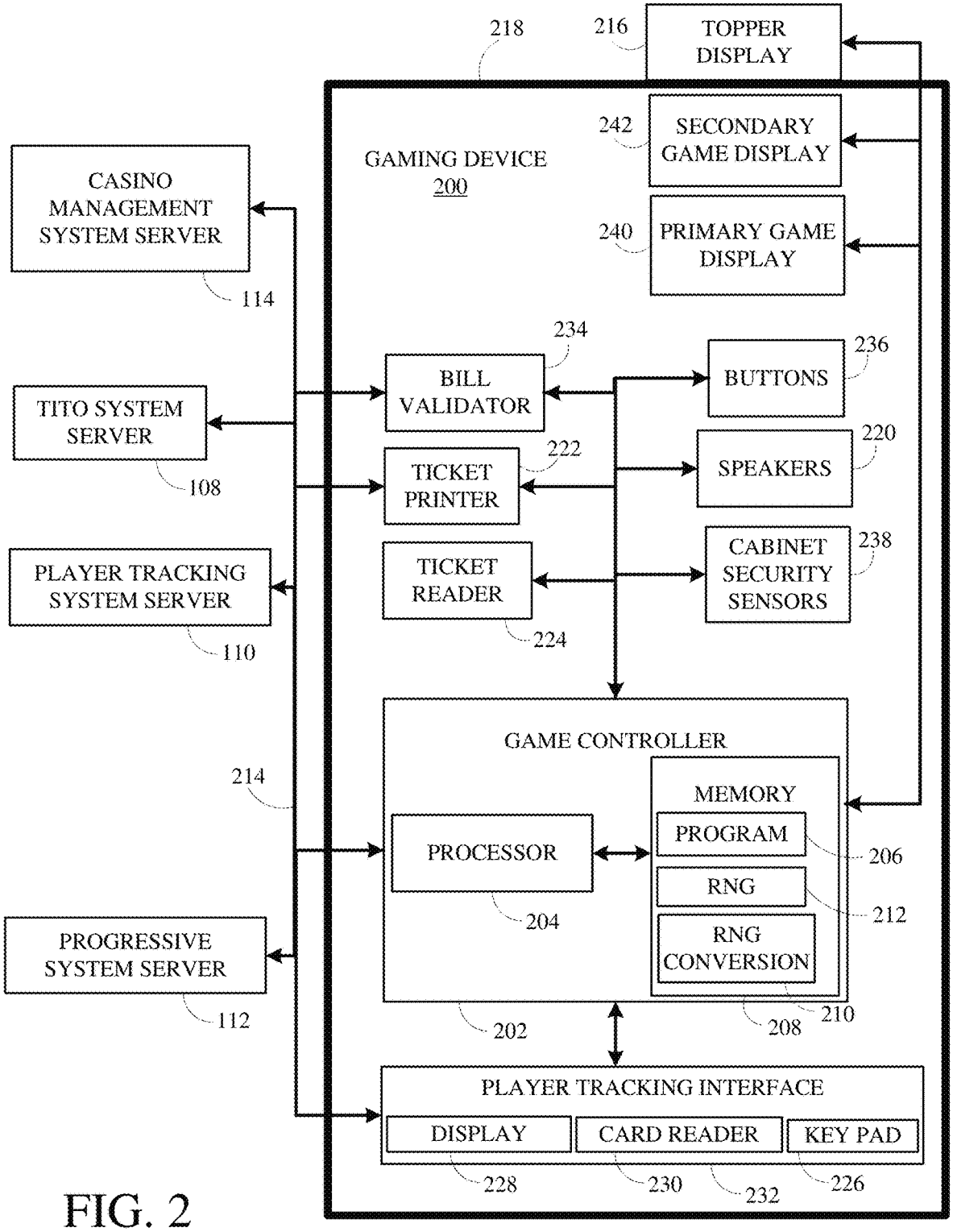
FIG. 2 is a block diagram illustrating an example of a networked EGM according to some embodiments.

Many or all the above described components can be controlled by circuitry (e.g., a gaming controller) housed inside the main cabinet 116 of the gaming device 104A, the details of which are shown in FIG. 2.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. The main display 128 is in a portrait orientation with curvature radius from top to bottom. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The main or service door may also be accessed to reset the machine, verify and/or upgrade the software, and for general maintenance operations.

Another example gaming device 104C shown is the Helix™ model gaming device manufactured by Aristocrat® Technologies, Inc. Where possible, reference numerals identifying similar features of the embodiments of gaming devices 104A and 104B are used to identify corresponding features of gaming device 104C.

Gaming device 104C does not include physical reels and instead shows game play functions on main display 128A and a secondary display 128B. Gaming device 104C includes a main display 128A that is in a landscape orientation. The main display 128A or secondary display 128B can be a high-resolution LCD, plasma, LED, OLED, or SED panel, Although not illustrated by the front view provided, the landscape display 128A may have a curvature radius from top to bottom, or alternatively from side to side. In some embodiments, display 128A is a flat panel display. Alternatively, the main display 128A can be a touchscreen display. Main display 128A is typically used for primary game play while secondary display 128B is typically used for bonus game play, to show game features or attraction activities while the game is not in play or any other information or media desired by the game designer or operator. The secondary display 128B may be in a landscape orientation with curvature radius from top to bottom, or may be flat. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

C. Example Components of Gaming Device.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1.

As shown in FIG. 2, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smartphone enabling player tracking. FIG. 2 also depicts utilizing a ticket printer 222 to print tickets for a TITO system server 108. Gaming device 200 may further include a bill validator 234, player-input buttons 236 for player input, and cabinet security sensors 238 to detect unauthorized opening of the cabinet 218, each coupled to and operable under the control of game controller 202. The game controller 202 may be a circuit (e.g., an electronic circuit board, a programmable computer chip, etc.) within a gaming device that, in addition to controlling other components, includes one or more processors that process game play instructions in accordance with game play rules, and outputs or generates game play outcomes to one or more displays.

The gaming device 200 includes several display screens, each coupled to and operable under the control of the game controller 202. A primary game display 240 acts as a main display 128, 128A as described with reference to FIG. 1. A secondary game display 242 acts as a secondary display 128B as described with reference to FIG. 1. The gaming device 200 can include a credit display that displays a player's current number of credits, cash, account balance, or the equivalent. The gaming device 200 can also include a bet display that displays a player's amount wagered. The credit display and/or bet display may be standalone displays, independent of the primary game display 240 and secondary game display 242. Alternatively, the credit display and/or bet display can be incorporated into the primary game display 240 or secondary game display 242. Any of the display screens can be implemented as a touchscreen, with an associated touchscreen controller. In this case, such display screens may be operated as input devices in addition to presenting information, to provide input game play decisions (e.g., actions on and selection of game presentation objects).

The games available for play on the gaming device 200 are controlled by a game controller 202. In general, the game controller 202 conducts a wagering game, generates gaming data (e.g., for wagers, game outcomes, payouts, player ratings, duration of play, and time between rounds of play), and, for each round of play of the wagering game, awards a payout or win amount according to a pay table. A base game can include a bonus game that the game controller 202 also conducts. In some example implementations, the game controller 202 processes game play instructions to perform the following operations. In response to a start condition, the game controller 202 selects active reels for a process (e.g., mode of a base reel game or bonus reel game). Each of the active reels has an associated reel strip that is movable through a reel area on the primary game display 240 of the gaming device 200 upon a spin of the reel. The active reels include one or more main reels and one or more side reels. The game controller 202 spins at least some of the active reels on the primary game display 240. The game controller 202 also selects a subset of the active reels, which includes at least one of the side reel(s). The game controller 202 shifts at least some of the active reels into the reel area while shifting at least some of the active reels out of the reel area, before stopping at the subset of the active reels. The shifting of the active reels can happen during the spinning of the active reels, before the spinning of the active reels starts, and/or after the spinning of the active reels stops. The game controller 202 determines an outcome of the process and outputs an indication of the outcome of the process. For example, the game controller 202 determines whether any win conditions exist (on pay lines) and awards win amounts to the player. More generally, the game controller 202 can process game play instructions and generate outcomes as described in Section III.

The game controller 202 includes one or more processors 204. Processor 204 represents a general-purpose processor, a specialized processor intended to perform certain functional tasks, or a combination thereof. As an example, processor 204 can be a central processing unit ("CPU") that has one or more multi-core processing units and memory mediums (e.g., cache memory) that function as buffers and/or temporary storage for data. Alternatively, processor 204 can be a specialized processor, such as an application specific integrated circuit ("ASIC"), graphics processing unit ("GPU"), field-programmable gate array ("FPGA"), digital signal processor ("DSP"), or another type of hardware accelerator. In another example, processor 204 is a system on chip ("SoC") that combines and integrates one or more general-purpose processors and/or one or more specialized processors. Although FIG. 2 illustrates that game controller 202 includes a single processor 204, game controller 202 is not limited to this representation and instead can include multiple processors 204 (e.g., two or more processors).

FIG. 2 illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory ("RAM"), read-only memory ("ROM"), hard disk drives, solid-state drives, universal serial bus ("USB") flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory ("SRAM"), dynamic random access memory ("DRAM"), magnetic random access memory ("MRAM"), and other such devices. Examples of ROM include a programmable read-only memory ("PROM"), an erasable programmable read-only memory ("EPROM"), an electrically erasable programmable read-only memory ("EEPROM"), or other like memory device. Even though FIG. 2 illustrates that game controller 202 includes a single memory 208, game controller 208 could include multiple memories 208 for storing program instructions and/or data.

Memory 208 can store one or more game programs 206 that provide program instructions and/or data for carrying out various embodiments (e.g., game mechanics) described herein. Stated another way, game program 206 represents an executable program stored in any portion or component of memory 208. In one or more embodiments, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be set up to generate one or more game instances based on instructions and/or data that gaming device 200 exchange with one or more remote gaming devices, such as a central determination gaming system server 106 (not shown in FIG. 2 but shown in FIG. 1). For purpose of this disclosure, the term "game instance" refers to a play or a round of a game that gaming device 200 presents (e.g., via a UI) to a player. Output for the game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a ROM) or from the central determination gaming system server 106 to memory 208.

When games are implemented in an online environment, at least a portion of the game software can be stored in a remote game server or in a cloud computing service. Game transactions such as adding money to the game (i.e., cash in) and withdrawing money from the game (i.e., cash out) are substituted by implementing electronic fund transfers. A player deposits money into his online gaming account via checks, debit cards, wire and the like. Once funded, the player can move a portion of the cash in his account into the game he wants to play. This process is referred to as account-based wagering. Account-based wagering is a convenient monetary transaction system for online and mobile wagering environments since the physical bill acceptor and ticket printer are not available. In addition to the accounting meters' separation, detection of the location where the wagering transaction take place is also performed in order to enforce local gaming regulations and properly calculate revenue, profit, and tax withholdings, for example. Thus, a remote gaming device can access a casino via a computer network and participate in a game of chance. The remote gaming device may be a PC, smartphone, or other computing device coupled to the Internet via a wired or wireless link (and, e.g., connecting to a casino management system via a virtual private network). The remote gaming device may be a terminal-based machine, where the actual game (including RNG and outcome determination) is hosted at a gaming server, with the terminal-based machine displaying results of the game via one or more display screens.

The game controller 202 can communicate over a network with one or more other gaming devices or other devices via a communication interface. The communication interface may operate as an input device (e.g., by receiving data from another device) and/or as an output device (e.g., by transmitting data to another device). The gaming device 200 can also include one or more communication ports that enable the game controller 202 to communicate with peripheral devices, external video sources, expansion buses, or display screens.

FIG. 2 depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g., amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or selecting various items during a feature game). The player may make these selections using the player-input buttons 236, the primary game display 240 which may be a touchscreen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Some embodiments described herein represent improvements in the technical area of EGM software and provide new technology, in that they improve usability of EGMs by enhancing the user experience, extending player time on the EGMs, and maintaining the interest of current users in the EGMs. In some example implementations, the shifting of active reels in a mode is visible to players. The mode shows what symbols are possible in the side reel(s). In particular, the staging of operations (with shifting from side-to-side) provides a build up to higher award amounts, which may occur as a reward to players for extended play on the gaming device 200. These embodiments are thus not merely new game rules or new display patterns.

Gaming devices such as gaming device 200 (as a generalized example of devices 104A-X) typically include special features and/or additional circuitry that differentiates them from general-purpose computers (e.g., desktop computers and laptops). Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness (e.g., that outcomes will be statistically independent, uniformly distributed over their range, unpredictable and pass statistical tests such as chi-square test, equi-distribution test, gap test, runs test, serial correlation test, etc.). Typically, gaming jurisdictions mandate that gaming devices 200 satisfy a minimum level of randomness without specifying how a gaming device 200 should achieve this level of randomness. To comply, FIG. 2 illustrates that gaming device 200 includes an RNG 212 that utilizes hardware and/or software to generate RNG outcomes that lack any pattern. The RNG 212 can be integrated into the game controller 202 or processor 204. The RNG operations are often specialized and non-generic in order to comply with regulatory and gaming requirements. For example, in a reel game, game program 206 can initiate multiple RNG calls to RNG 212 to generate RNG outcomes, where each RNG call and RNG outcome corresponds to an outcome for a reel. (Gaming regulations may require that each reel outcome be independent of each other reel outcome, such that no reel outcome depends on any other reel outcome.) In another example, gaming device 200 can be a Class II gaming device where RNG 212 generates RNG outcomes for creating Bingo cards. In one or more embodiments, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred to as a "random number").

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%).

A game can use one or more lookup tables (also called weighted tables) as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP. (In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts.) Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility.

FIG. 2 illustrates that gaming device 200 includes an RNG conversion engine 210 that translates the RNG outcome from RNG 212 to a game outcome presented to a player. To meet a designated RTP, a game developer can setup the RNG conversion engine 210 to utilize one or more lookup tables (e.g., weighted tables) to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

As noted, gaming devices 200 are specially-configured computer systems and not merely general-purpose computers. For example, one difference between a gaming device 200 and common processor-based computer system is that gaming device 200 is designed to be a state-based system. In a state-based system, the system stores and maintains its current state in non-volatile memory, which can be implemented using battery-backed RAM, flash memory, a solid-state drive, or other persistent memory. Different functions of a game (e.g., bet, play, result, points in the graphical presentation, etc.) may be defined as a state. When a game moves from one state to another, data regarding the game state is stored in a custom non-volatile memory subsystem. In some cases, the gaming device 200 does not advance from a current state to a subsequent state until information that allows the current state to be reconstructed is stored. In the event of a power failure or other malfunction, the gaming device 200 will return to its current state when the power is restored by recovering state information from non-volatile memory. The restored state may include metering information and graphical information that was displayed on the gaming device 200 in the state prior to the malfunction. For instance, if a player was shown an award for a game of chance and, before the award could be provided to the player, the power failed, the gaming device 200, upon the restoration of power, would return to the state where the award is indicated. More generally, the gaming device 200 records, in non-volatile memory, the values of game parameters assigned during play, such as variables determined by an RNG or internal counters. (A game parameter, in general, can be one or more variables whose values govern play at the gaming device and depend on a random selection process.) The value of a game parameter can be recorded periodically, in response to some event such as user input, or whenever the value of the game parameter changes. This way, the gaming device 200 can recover its state in case of a power failure or "tilt" event, allowing the gaming device 200 to reconstruct events that have taken place before the power failure or "tilt" event. In contrast, PCs are not state machines to the same extent, and a majority of data is usually lost when a malfunction occurs. This requirement affects the software and hardware design on a gaming device 200. Game history information regarding previous games played, such as an amount wagered, the outcome of the game and so forth, may also be stored in a non-volatile memory device.

In the context of the innovations described herein, for example, when a game controller 202 of a gaming device 200 manages operations to shift active reels into and out of a reel area, the game controller 202 can save information about state in non-volatile memory at various stages. After starting a process that uses reels on a display screen of the gaming device 200, the game controller 202 can save information in non-volatile memory that indicates a default configuration of the reels. The non-volatile memory can also store other state information, such as a current bet amount, control level (e.g., current bet level), an amount of credits remaining, and/or a win amount for a base game. After a mode with shifting of active reels has been triggered, the non-volatile memory can store an indication that the mode has started. After using an RNG to determine which side reel(s) are active reels for the mode, the game controller 202 can save information in non-volatile memory that indicates the set of active reels. After using an RNG to determine a subset of the active reels to stop in the reel area (e.g., determine an offset of x reels to the left or right), the game controller 202 can save information in non-volatile memory that indicates the subset of active reels. More generally, non-volatile memory can store state information such as positions of the respective reels, in addition to storing information that indicates the configuration of reel strips of the reels. After a spin, the game controller 202 can update the values in non-volatile memory that indicate the positions of the respective reels. State information in non-volatile memory can even be updated in a more fine-grained way, e.g., for each reel of a spin, after that reel lands in the reel area. After exiting the mode, the game controller 202 can store information in non-volatile memory that indicates an outcome of the process (e.g., award amount).

Although FIGS. 1 and 2 illustrates specific embodiments of a gaming device (e.g., gaming devices 104A-104X and 200), the disclosure is not limited to those embodiments shown in FIGS. 1 and 2. For example, not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

Additionally, or alternatively, gaming devices 104A-104X and 200 can include credit transceivers that wirelessly communicate (e.g., Bluetooth or other near-field communication technology) with one or more mobile devices to perform credit transactions. As an example, bill validator 234 could contain or be coupled to the credit transceiver that output credits from and/or load credits onto the gaming device 104A by communicating with a player's smartphone (e.g., a digital wallet interface).

Gaming devices 104A-104X and 200 may also include other processors that are not separately shown. Using FIG. 2 as an example, gaming device 200 could include display controllers (not shown in FIG. 2) configured to receive video input signals or instructions to display images on game displays 240 and 242. Alternatively, such display controllers may be integrated into the game controller 202. The use and discussion of FIGS. 1 and 2 are examples to facilitate ease of description and explanation.

Those of skill in the art will appreciate that embodiments of the present disclosure could be implemented with more or fewer elements than are depicted in FIG. 2. The pictured example embodiments of a gaming device 200, as well as example gaming devices 104A-C, are merely a few examples from a wide range of possible gaming device designs on which embodiments of the present disclosure may be implemented. Depending on implementation and the type of processing desired, components of the gaming device 200 can be added, omitted, split into multiple components, combined with other components, and/or replaced with like components. In alternative embodiments, gaming devices with different components and/or other configurations of components perform one or more of the described techniques. Specific embodiments of gaming devices typically use a variation or supplemented version of the gaming device 200. The relationships shown between components within the gaming device 200 indicate general flows of information in the gaming device 200; other relationships are not shown for the sake of simplicity. In general, the game controller 202 can be implemented by software executable on a CPU, by software controlling special-purpose hardware, or by special-purpose hardware (e.g., in an ASIC).

D. Example Game Processing Architecture.

Figure 3:
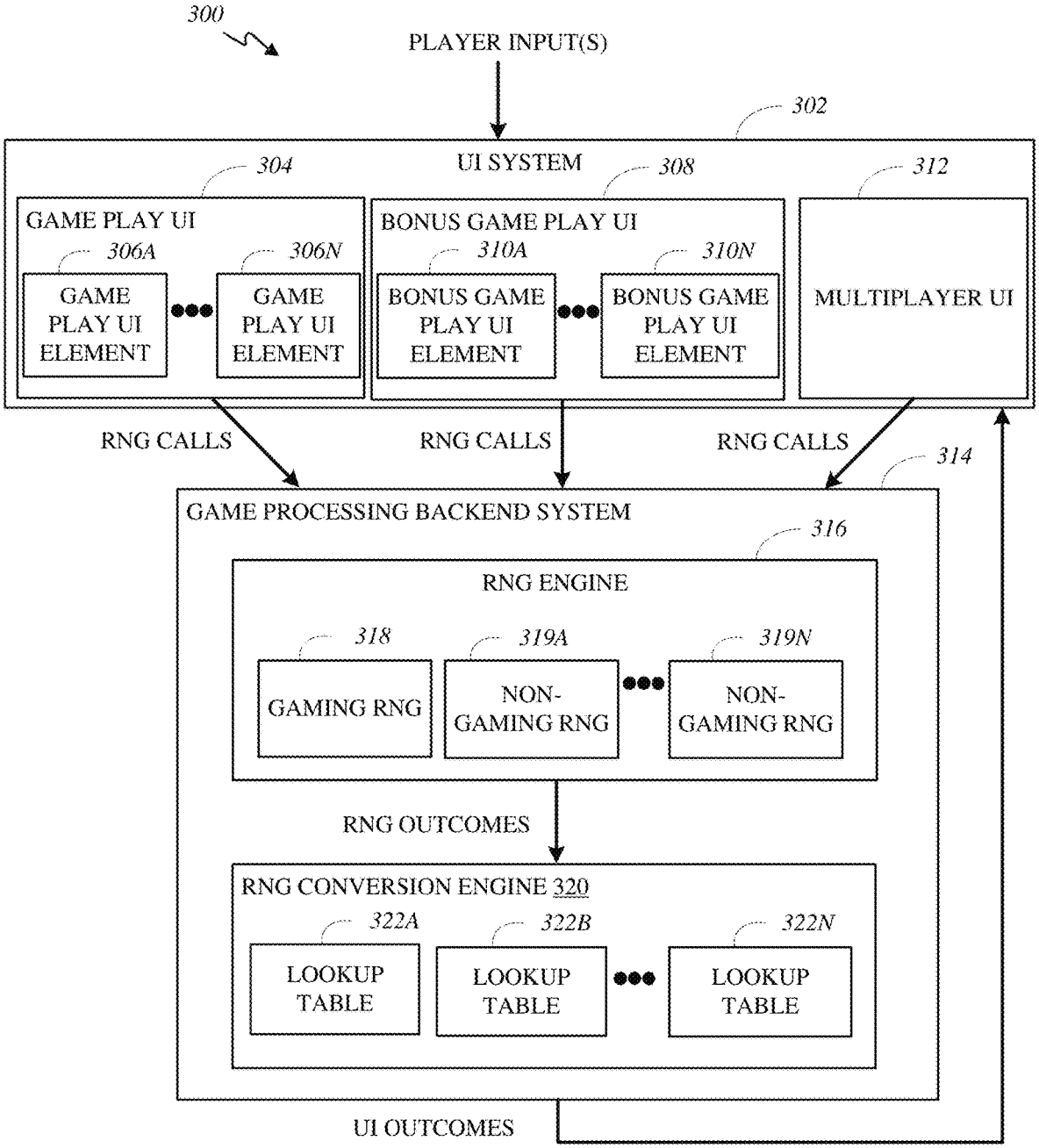
FIG. 3 is a block diagram illustrating an example game processing architecture that implements a game processing pipeline for the play of a game in accordance with some embodiments.

FIG. 3 illustrates, in block diagram form, an example game processing architecture 300 that implements a game processing pipeline for the play of a game in accordance with various embodiments described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes, based on the RNG outcomes, for the UI system 302 to use to control game play (e.g., a display to a player). The game processing architecture 300 can implement the game processing pipeline using a gaming device, such as one of the gaming devices 104A-104X and 200 shown in FIGS. 1 and 2, respectively. Alternatively, portions of the gaming processing architecture 300 can implement the game processing pipeline using a gaming device and one or more remote gaming devices, such as central determination gaming system server 106 shown in FIG. 1.

The UI system 302 includes one or more UIs that a player can interact with. The UI system 302 could include one or more game play UIs 304, one or more bonus game play UIs 308, and one or more multiplayer UIs 306, where each UI type includes one or more mechanical UIs and/or graphical UIs (GUIs). In other words, the game play UI 304, bonus game play UI 308, and multiplayer UI 312 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more embodiments, at least some of the game play UI element 306A-306N are similar to the bonus game play UI elements 310A-310N. In other embodiments, the game play UI element 306A-306N can differ from the bonus game play UI elements 310A-310N.

FIG. 3 also illustrates that UI system 302 could include a multiplayer UI 312 purposed for game play that differs or is separate from the typical base game. For example, multiplayer UI 312 could be set up to receive player inputs and/or present game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces ("APIs") to generate the RNG calls. To process the RNG calls, the RNG engine 316 could utilize gaming RNG 318 and/or non-gaming RNGs 319A-319N. Gaming RNG 318 corresponds to RNG 212 shown in FIG. 2. As previously discussed with reference to FIG. 2, gaming RNG 318 often performs specialized and non-generic operations that comply with regulatory and/or game requirements. For example, because of regulation requirements, gaming RNG 318 could be a cryptographic random or pseudorandom number generator ("PRNG") (e.g., Fortuna PRNG) that securely produces random numbers for one or more game features. To generate random numbers, gaming RNG 318 could collect random data from various sources of entropy, such as from an operating system ("OS"). Alternatively, non-gaming RNGs 319A-319N may not be cryptographically secure and/or be computational less expensive. Non-gaming RNGS 319A-319N can, thus, be used to generate outcomes for non-gaming purposes. As an example, non-gaming RNGs 319A-319N can generate random numbers for purposes such as generating random messages that appear on the gaming device.

The RNG conversion engine 320 processes each RNG outcome from RNG engine 316 and converts the RNG outcome to a UI outcome that is fed back to the UI system 302. With reference to FIG. 2, RNG conversion engine 320 corresponds to RNG conversion engine 210 used for game play. As previously described, RNG conversion engine 320 translates the RNG outcome from the RNG 212 to a game outcome presented to a player. For example, RNG conversion engine 320 utilizes one or more lookup tables 322A-322N (weighted tables) to regulate a prize payout amount for each RNG outcome and how often the gaming device pays out the derived prize payout amounts. In one example, the RNG conversion engine 320 could utilize one lookup table to map the RNG outcome to a game outcome displayed to a player and utilize a second lookup table as a pay table for determining the prize payout amount for each game outcome. In this example, the mapping from the RNG outcome to the game outcome can affect the level of volatility for the game, e.g., by regulating the frequency of occurrence of a game feature such as hitting certain prize payout amounts, triggering a bonus game or special mode, winning a progressive jackpot, etc. Different lookup tables could be utilized depending on the different game modes, for example, a base game versus a bonus game. In the context of the innovations described herein, for example, one or more lookup tables can be used to determine which side reels to include (along with main reels) in a set of active reels, determine a subset of the active reels at which shifting of reels stops, and/or determine characteristics of the reel shifting operations such as the count of iterations of shifting, the extent of shifting in given iteration, and the timing of shifting animations.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to the updating the appropriate UI, the player may subsequently provide additional player inputs to initiate a subsequent game instance that progresses through the game processing pipeline.

In general, the example game processing architecture 300 shown in FIG. 3 can be used to process game play instructions and generate outcomes as described in Section III. For example, in some example implementations, the example game processing architecture 300 implements a game processing pipeline for a process (e.g., mode of a base reel game or bonus reel game) that includes shifting side reels into and out of a reel area. In response to a start condition, the game play UI 304 (or bonus game play UI 308) makes one or more RNG calls to the game processing backend system 314. In response, the backend system 314 performs various operations. Using a gaming RNG 318, the RNG engine 316 generates one or more random numbers, which are passed to the RNG conversion engine 320. The RNG conversion engine 320, using one or more of the random number(s) and one or more of the lookup tables 322A . . . 322N, selects active reels for the process. The active reels include one or more main reels and one or more side reels. In particular, the game processing backend system 314 selects the side reel(s) to use in the process. The RNG conversion engine 320 also, using one or more of the random number(s) and one or more of the lookup tables 322A . . . 322N, selects a subset of the active reels, which will show symbols in the reel area when shifting of the reels stops. Using the gaming RNG 318, the RNG engine 316 determines more random numbers, which the RNG conversion engine 320 uses (along with one or more of the lookup tables 322A . . . 322N) to determine symbol stop positions for the respective reels of the subset of active reels. The backend system 314 can also determine the outcome of the process (e.g., calculating whether any win conditions exist on pay lines).

The backend system 314 returns the generated results to the game play UI 304 (or bonus game play UI 308), which spins at least some of the active reels and shifts at least some of the active reels into the reel area while shifting at least some of the active reels out of the reel area, before stopping at the subset of the active reels. With respect to shifting operations, the generated results returned by the backend system 314 can include game-related outcomes (such as the side reels in a set of active reels, the subset of active reels shown when reel shifting stops, and symbol stop positions for the respective reels) as well as shift animation effects not related to game outcomes. For example, the backend system 314 can return results of a single RNG call, for which a single RNG is mapped using a lookup table that defines some game-related outcomes (such as side reels in a set of active reels, and the subset of active reels shown when reel shifting stops) as well as shift animation effects (such as the extent of shifting to the respective sides). Alternatively, with respect to the shifting operations, the game play UI 304 (or bonus game play UI 308) can make one or more separate RNG calls to the backend system 314 to determine shift animation effects. In response, the backend system 314 can use the gaming RNG 318 and/or one or more of the non-gaming RNGs 319A . . . 319N to generate random numbers, which the RNG conversion engine 320 uses (with one or more of the lookup tables 322A . . . 322N) to determine shift animation effects for the shifting operations. The game play UI 304 (or bonus game play UI 308) can perform shifting operations consistent with the shift animation effects, which are returned from the backend system 314.

Eventually, the game play UI 304 (or bonus game play UI 308) stops the spinning of the reels in the subset of active reels at the symbol stop positions returned for the respective reels. Finally, the game play UI 304 (or bonus game play UI 308) outputs an indication of the outcome of the process.

II. Examples of Game Play Dynamics when Shifting Side Reels into/Out of Reel Area.

This section describes various innovations in user interface ("UI") features of electronic gaming machines ("EGMs"), as well as innovations in features of backend processing for EGMs to implement the UI features. Some of the innovations relate to processes for EGMs that shift side reels into and out of a reel area of a display screen. In particular, some examples described herein relate to a mode for a base reel game in which side reels shift into/out of a reel area of a display screen. In some example implementations, as part of a special mode for a base reel game, one or more side reels to the left of a set of main reels (e.g., from the base reel game) and one or more side reels to the right of the set of main reels shift into and out of the reel area of the display screen during a spin. Eventually, after the reels have shifted back and forth through the reel area several times, the reel shifting operations stop, with the reel area now typically including at least one of the side reels. After the reels stop spinning in the reel area, win conditions on pay lines across the reel area are awarded. Compared to the symbols of the main reels, the side reels typically include symbols of greater interest to a user, due to their enhanced value when calculating win conditions on pay lines (e.g., wild symbols, multiplier symbols, special character symbols). As such, shifting side reels into and out of the reel area can increase game volatility while maintaining a designated level of RTP.

A. Introduction and Example Hardware.

Depending on implementation, various form factors of EGMs can incorporate these innovations. For example, for a "thick client" implementation, an EGM (such as a gaming device 104A-X in FIG. 1 or gaming device 200 in FIG. 2) stores computer-executable instructions for controlling one or more wagering games in local memory of the EGM and executes those instructions in one or more local processors of the EGM. The computer-executable instructions for controlling the game(s) may be stored within the EGM (e.g., at a factory) prior to installation of the EGM at a gaming establishment. Or, the computer-executable instructions for controlling the game(s) may be stored within the EGM after installation of the EGM at a gaming establishment (e.g., by downloading the instructions to the EGM over a network, or by installing memory that stores the instructions into the EGM, then configuring the EGM). In such a "thick client" implementation, a game controller of the EGM conducts one of the wagering game(s) and manages various interfaces of the EGM to receive player inputs and commands. Or, as another example, for a "thin client" implementation, computer-executable instructions for controlling one or more wagering games are stored in memory of a gaming server (e.g., central determination gaming system server or other remote host) and executed in one or more processors of the gaming server. The game server remotely controls one of the wagering game(s) over a network, and the EGM displays screens for the wagering game and manages interfaces to receive player inputs and commands.

The wagering games can include base games as well as bonus games. A "base" or "primary" game may, for example, include play that involves spinning reels. A "bonus" or "secondary" game/feature can add the possibility of winning a relatively large payout. A bonus game/feature may require an additional wager, but typically does not. A single play of a game can constitute a single complete game or wager, e.g., a single spin of the reels or a series of spins which culminate in a final aggregate outcome.

In some example implementations, the EGM or gaming server can conduct a base reel game (for regular play or free spins), a bonus reel game, and a gateway wheel game. The base reel game and bonus reel game use spinning reels and a reel area on a display screen. As in a typical reel game, the reels of the base reel game or bonus reel game "spin" graphically through the reel area on the display screen when a user actuates a "spin" or "play" button, which acts as a "handle pull" event. A game controller randomly selects positions in the respective reels, and the respective reels stop at the selected positions, with some number of symbols visible in the reel area for each of the reels. For example, for a given reel, the game controller generates a random number and determines a position on the reel strip of the reel using the random number (e.g., with a weighted table). The game controller generates different random numbers for the respective reels that are spun. In this way, the game controller determines which symbols of the respective reels are visible in the reel area on the display screen.

In general, a display screen (or simply "display" or "screen") is an area that conveys information to a viewer. The information may be dynamic, in which case, the display screen may use LCD technology, LED technology, CRT technology, or some other display technology. A main display screen (also called a primary game screen or main display) can be a display screen or an area of a display screen used to display game information related to a base game, such as a video representation of one or more spinning reels. A secondary display screen (also called a secondary game screen or bonus display) can be a display screen or an area of a display screen used to display secondary game information, such as animations and other graphics associated with a bonus game.

A base reel game or bonus reel game may award a special mode to a player. A special mode may enhance an EGM and the experience of players by adding elements of excitement and chance. The special mode can utilize a different set of reels, display screens, controls, symbols, etc. than the base reel game or bonus reel game in normal operation. Alternatively, the special mode can reuse or reconfigure at least some of the reels, display screens, symbols, etc. of a base reel game or bonus reel game. The special mode for a base reel game or bonus reel game can be started in response to satisfaction of a start condition. For example, the special mode can be randomly triggered. Alternatively, the special mode can be triggered in some other way (e.g., a combination of symbols in a previous play).

B. Example Reel Area and Reels in Special Mode.

Figure 4:
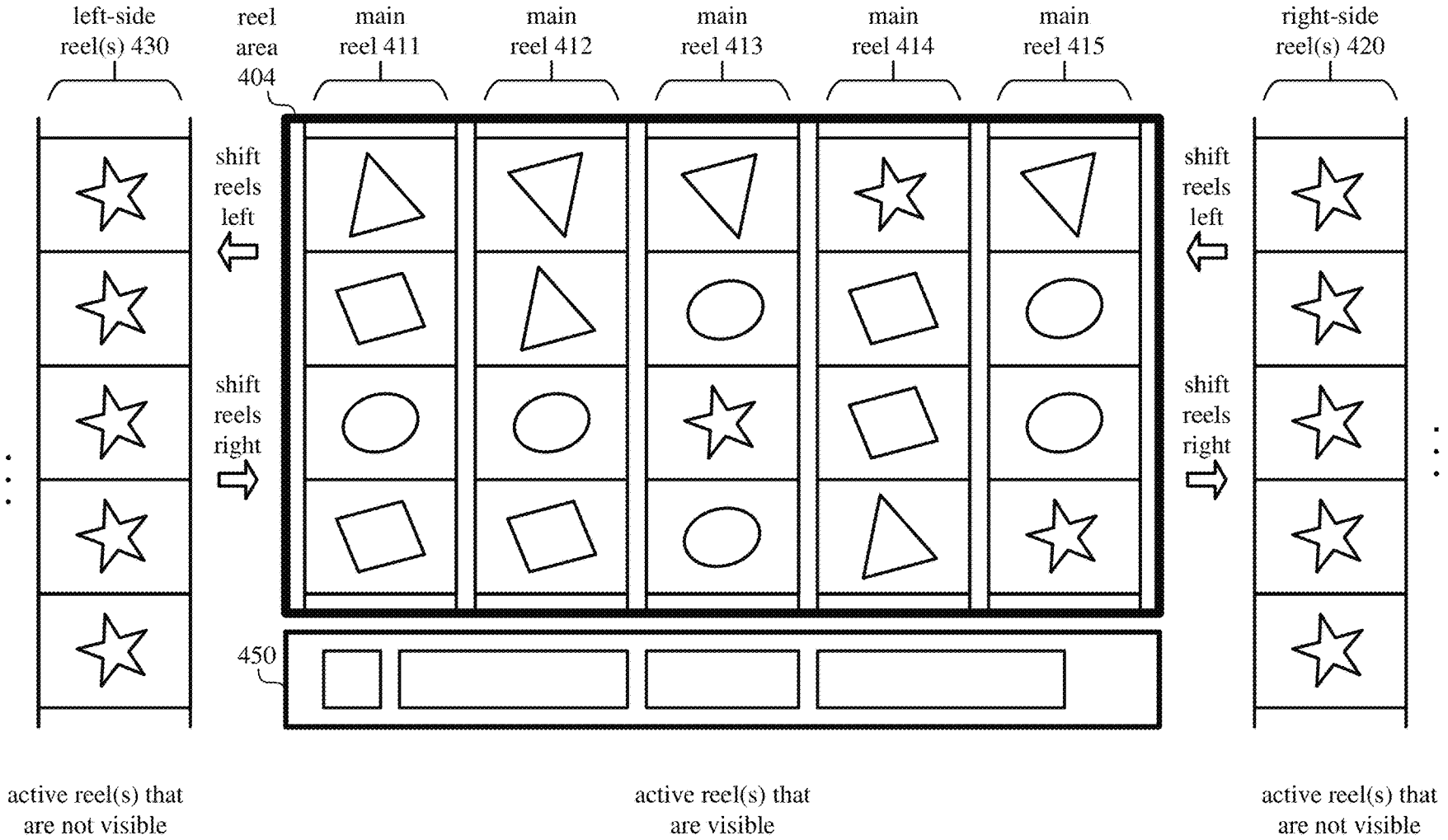
FIG. 4 is a representation of an example screen shot of a display screen of an EGM for a special mode of a reel game, according to some example implementations.

FIG. 4 is a diagram that represents an example screen shot of a display screen of an electronic gaming device such as an EGM for a special mode of a base reel game or bonus reel game, according to some example implementations. The example screen shot may be rendered on a main display screen, secondary display screen, or other display screen of an electronic gaming device such as an EGM. The display screen includes a reel area 404 and a supplemental information area 450. In particular, the example screen shot illustrates active reels that can be shifted into and out of the reel area 404.

The reel area 404 (shown with a heavy line in FIG. 4) encloses viewable portions of reels. In FIG. 4, the reel area 404 encloses viewable portions of five reels. For each of the five reels, the viewable portion of the reel include four positions of symbols, which span the reel area 404. The symbols include special symbols (e.g., wild symbols) and other symbols. The symbols on the main reels and side reels can be static or animated. Thus, the reel area 404 is a matrix of symbols on the display screen, and may be highlighted graphically to emphasize reels and symbols within the reel area 404. The number of reels and dimensions of the reel area 404 depend on implementation. In general, the reel area 404 has an m×n configuration, with m reels and with n symbols visible per reel. In some example implementations shown in FIGS. 8*a*-8*m*, the reel area has a 5×3 configuration—five reels on the display screen, with three symbols showing in the reel area for each of the reels. Alternatively, the reel area 404 can have another configuration. For example, the reel area 404 can have different numbers of symbols visible for different reels (e.g., going left to right in the reel area 404, two symbols visible for a leftmost reel, three symbols visible for a second reel, four symbols visible for a center reel, three symbols visible for a fourth reel, and two symbols visible for a rightmost reel). The reel area for a base reel game and reel area for a bonus reel game can be the same or different.

The supplemental information area 450 presents information such as a current bet amount, a current bet level (e.g., 1×, 2×, 3×, 4×, 5×), a count of pay lines that are monitored, an amount of credits remaining, and/or a win amount for a round of play. As explained below, the supplemental information area 450 can include a graphic (e.g., image, animation) that emphasizes shifting of reels into and out of the reel area 404.

The special mode uses a set of active reels. The set of active reels includes one or more main reels and one or more side reels. In FIG. 4, the active reels include five main reels 411-415, one or more left-side reels 430, and one or more right-side reels 420. The numbers of active reels can change depending on implementation. In some example implementations, the active reels are five main reels, three left-side reels, and three right-side reels. In other example implementations, the active reels are five main reels, five left-side reels, and five right-side reels. The number of side reels on each side can be pre-determined. Or, the number of side reels on each side can vary (e.g., randomly, or depending on bet level). The number of side reels can be the same on each side. Or, different sides can have different numbers of side reels. Example approaches to selecting the active reels to use in a special mode (specifically, selecting side reels to use along with main reels) are described in section III.

The main reel(s) are default reels for the special mode. For example, the main reel(s) can be the reel(s) used in regular play for a base reel game or bonus reel game. In this case, the main reel(s) are retained for use in the special mode. This provides continuity in the transition from regular play to the special mode. For each of the main reel(s), a reel strip includes x positions along a one-dimensional strip of symbols, where x depends on implementation. For example, x is 30, 80, 100, 200, or some other number of positions. The value of x can be the same or different for different main reels (thus, different main reels can have different numbers of positions). Each main reel can have a data structure (e.g., array, linked list) that tracks the symbols at the respective positions of the reel strip for the main reel. In some example implementations, the configuration of the symbols at the positions of the reel strips for the main reel(s) of a base reel game is fixed after the base reel game boots, although limited reconfiguration operations may be permitted. In other example implementations, the configuration of the symbols at the positions of the reel strips for the main reel(s) of a base reel game can change dynamically after the base reel game boots (e.g., depending on bet level or some other factor). The configuration of symbols at positions of reel strips for main reel(s) of a bonus reel game can change for each instance of the bonus reel game, or even within a bonus reel game. The count of symbol positions can be the same for each of the main reels within a base reel game (or bonus reel game) or different for different main reels, and the count of symbol positions per reel may be different between a base reel game and bonus reel game. The symbol set for the main reel(s) includes various symbol types. In some example implementations, the symbol set for the main reel(s) includes a jackpot symbol type, a wild symbol type, some number of picture symbol types, some number of minor/low symbol types, and a scatter symbol type (which triggers bonuses). Alternatively, the symbol set for the main reel(s) can include other and/or additional symbols.

For each of the side reel(s), a reel strip includes y positions along a one-dimensional strip of symbols, where y depends on implementation. For example, y is 5, 8, 10, or some other number of positions. The value of y can be the same or different for different side reels (thus, different side reels can have different numbers of positions). Each side reel can have a data structure (e.g., array, linked list) that tracks the symbols at the respective positions of the reel strip for the side reel. The symbol set for the side reel(s) typically includes various symbol types. In some example implementations, the symbol set for the side reel(s) includes a wild symbol type, some number of special character symbol types, and some number of multiplier symbol types. Alternatively, the symbol set for the side reel(s) can include other and/or additional symbols.

The side reel(s) are selected from a set of candidate reels. For example, the set of candidate reels includes reels of wild symbols, reels of special symbols (character symbols), and reels of multiplier symbols (e.g., 2×, 3×, 4×). Alternatively, the set of candidate reels includes other and/or additional reels. The side reel(s) can have symbols drawn from the same set of symbols as the main reel(s). Or, the side reel(s) can have symbols drawn from a different set of symbols than the main reel(s). The number of candidate reels and configurations of candidate reels dependent on implementation.

For example, the set of candidate reels includes 36 reels, and each of the 36 reels includes five symbols (stopping positions).

The candidate reels can be configured dynamically or pre-determined for the special mode. In general, the configuration of the symbols at the positions of the reel strips for the side reel(s) of the special mode is fixed after a base reel game boots, although limited reconfiguration operations may be permitted. The count of symbol positions can be the same for each of the side reels for the special mode, or the count of symbol positions per side reel may be different. The count of symbol positions can the same for each of the active reels, or the count of symbol positions per reel can be different between the main reel(s) and side reel(s).

C. Example Shifting Operations.

As indicated in FIG. 4, the active reels can be shifted from side to side to change which of the active reels are visible in the reel area 404. For example, if the active reels are initially shifted to the left, one or more of the right-side reel(s) 420 are shifted into the reel area 404, and one or more of the main reels 411-415 are shifted out of the reel area 404. Or, if the active reels are initially shifted to the right, one or more of the left-side reel(s) 430 are shifted into the reel area 404, and one or more of the main reels 411-415 are shifted out of the reel area 404. After initial shifting, one or more of the main reels 411-415 that were previously shifted out of the reel area 404 may be shifted back into the reel area, and one or more of the side reel(s) 420, 430 that were previously shifted into the reel area 404 may be shifted out of the reel area 404. In this way, the active reels can shift back and forth across the reel area 404 multiple times. The number of times that the active reels shift back and forth can be pre-defined or depend on a random event (e.g., result of looking up a random number in a weighted table). Example approaches to deciding which directions to shift the active reels and/or deciding how far to shift the active reels are described in Section III. Various other features of the animation of the shifting operations (such as the hold time upon reaching the full extent of a reel shift, before shifting in the opposite direction; or the speed and/or acceleration/deceleration in a reel shift) can be pre-defined or depend on a random event (e.g., result of looking up a random number in a weighted table). In particular, having a variable hold time (such as no delay, 1× delay, 2× delay, or 3× delay) upon reaching the full extent of a reel shift can add unpredictability, since side reel(s) that are shown in the reel area 404 might or might not end up being used to determine an outcome after the reel shifting finally stops.

Eventually, the shifting of the active reels across the reel area 404 stops, and the reel area includes a subset of the active reels. Typically, the reel area 404 includes at least one side reel after the shifting of the active reels stops (e.g., at least one left-side reel or at least one right-side reel). Alternatively, the reel area 404 can include only main reels after the shifting of the active reels stops. Section III also describes example approaches to selecting the subset of active reels to stop in the reel area.

The shifting of the active reels across the reel area 404 can happen concurrently with spinning of the active reels. Section III describes example approaches to spinning active reels.

D. Example Outcome Determination.

After the reels of the subset of active reels have landed (stopped) in the reel area for the special mode, any win conditions are detected and any win amounts are awarded to the player (e.g., credited to the player's credit balance). The special mode defines one or more win conditions, the occurrence of which results in a win amount being awarded. For example, win conditions are defined as pay lines (also called win lines) across at least a portion of the reel area on a display screen. For a round of play, when a certain combination of symbols appears along a pay line, a win amount corresponding to that combination of symbols and that pay line is awarded. Win amounts can vary according to the combination of symbols and according to the particular pay line along which the combination of symbols appears. Win amounts are typically determined according to a pay table defined for the base reel game, where the pay table comprehends the various combinations of symbols and pay lines, i.e., the win conditions that may occur in the base reel game. (The win conditions for the special mode can be evaluated in the same way as win conditions for a base reel game, with win conditions being more likely in the special mode due to the occurrence of special symbols in the side reel(s).) The win amount for a round of play may be a fraction of an amount wagered for that round of play for certain win conditions. For other win conditions, the win amount may be much larger than the amount wagered.

The number of pay lines and base credit cost to play depends on implementation. In some example implementations, there are 50 pay lines and a 75 credit cost. There are 2×, 3×, 4×, and 5× bet multipliers (also called bet levels), which sets a max bet of 375 credits. Multipliers can also appear as symbols in side reels. Alternatively, there could be higher bet multipliers (e.g., up to 8×, with a max bet of 600 credits), different credit options, and/or a different number of pay lines.

Alternatively, instead of evaluating win conditions on pay lines across reels in the reel area, an award can be determined according to a "ways" approach. For example, a player may obtain a win entitlement by selecting a number of reels to play and an amount to wager per reel. Examples of such implementations may be marketed under the trade name "Reel Power" by Aristocrat Leisure Industries Pty Ltd. The selection of a reel means that each displayed symbol of the reel (in the reel area) can be substituted for a symbol at one or more designated display positions. In other words, all symbols displayed at symbol display positions in the reel area for a selected reel can be used to form symbol combinations (one symbol per reel in a combination) with any of the symbols displayed at designated, symbol display positions of each of the other reels. For example, if there are five reels and three symbol display positions for each reel (such that the symbol display positions comprise three rows of five symbol display positions), the symbol displayed in the center row is used for a non-selected reel, and the symbols displayed in all three rows are used for a selected reel. Each possible path through the designated (active) symbol display position(s) of the respective reels provides a way to win. As a result, the total number of ways to win is determined by multiplying the number of active display position(s) of each reel, where the active display position(s) for a reel are all display positions in the reel area for a selected reel but only the designated (e.g., center) display position in the reel area of a non-selected reel. As a result, for five reels and fifteen display positions, there are $3^5=243$ ways to win if five reels are selected, $3\times3\times3\times1\times1=27$ ways to win if three reels are selected, and so on.

E. Example Technical Effects.

In terms of technical effects, innovative features of the special mode described herein can improve usability of EGMs by enhancing the user experience, extending player time on the EGMs, and maintaining the interest of current users in the EGMs. In some example implementations, the shifting of active reels in the special mode is visible to players. The special mode shows what symbols are possible in the side reel(s). In particular, the staging of operations (with shifting from side-to-side) provides a build up to higher award amounts that is engaging for players.

III. Example Techniques for Shifting Side Reels into/Out of a Reel Area.

Figure 5A:
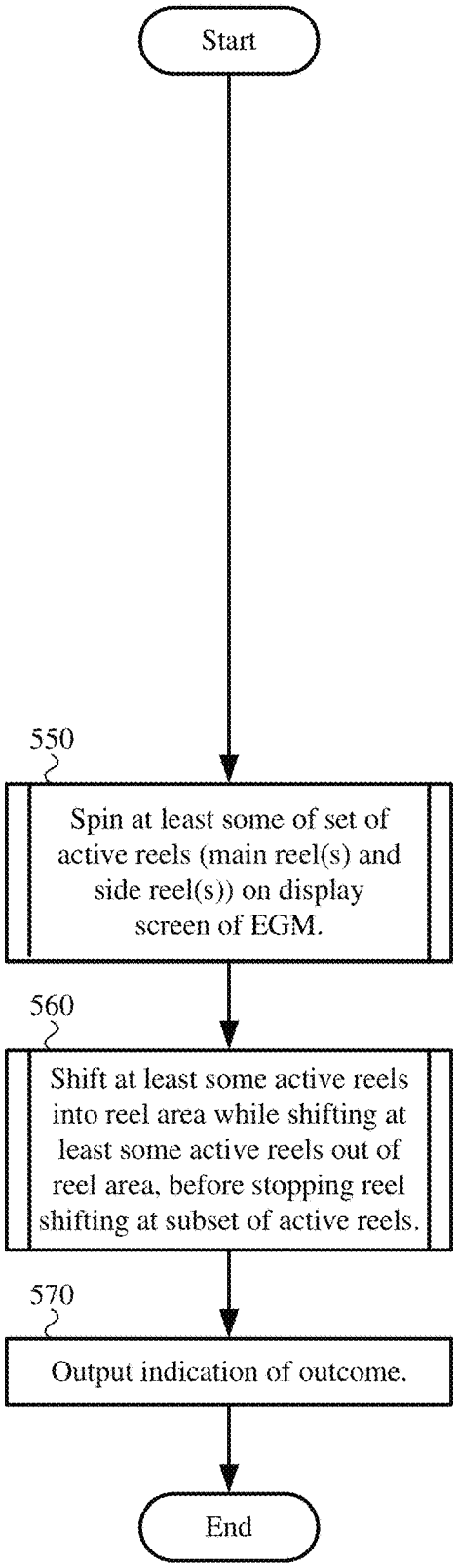
FIGS. 5*a* and 5*b* are flowcharts illustrating example techniques for shifting reels into and out of a reel area on a display screen of an electronic gaming device such as an EGM, from the perspective of a UI frontend and backend, respectively.
Figure 5B:
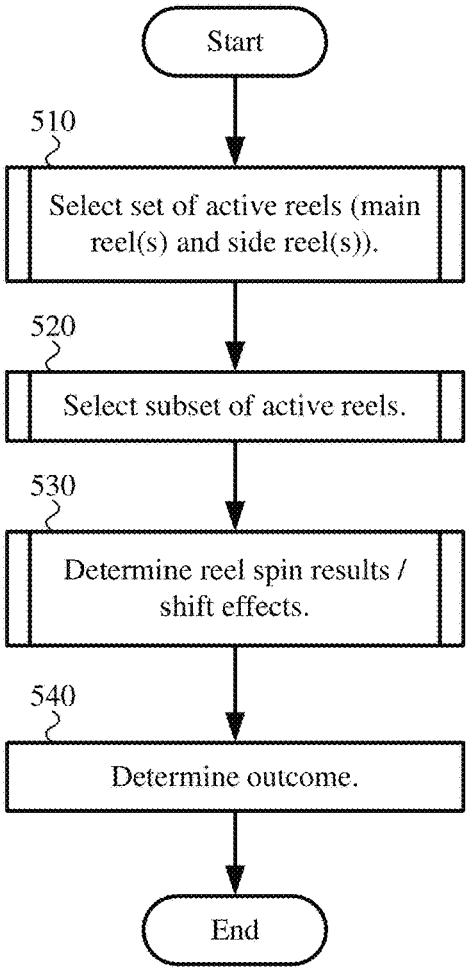
Figure 5C:
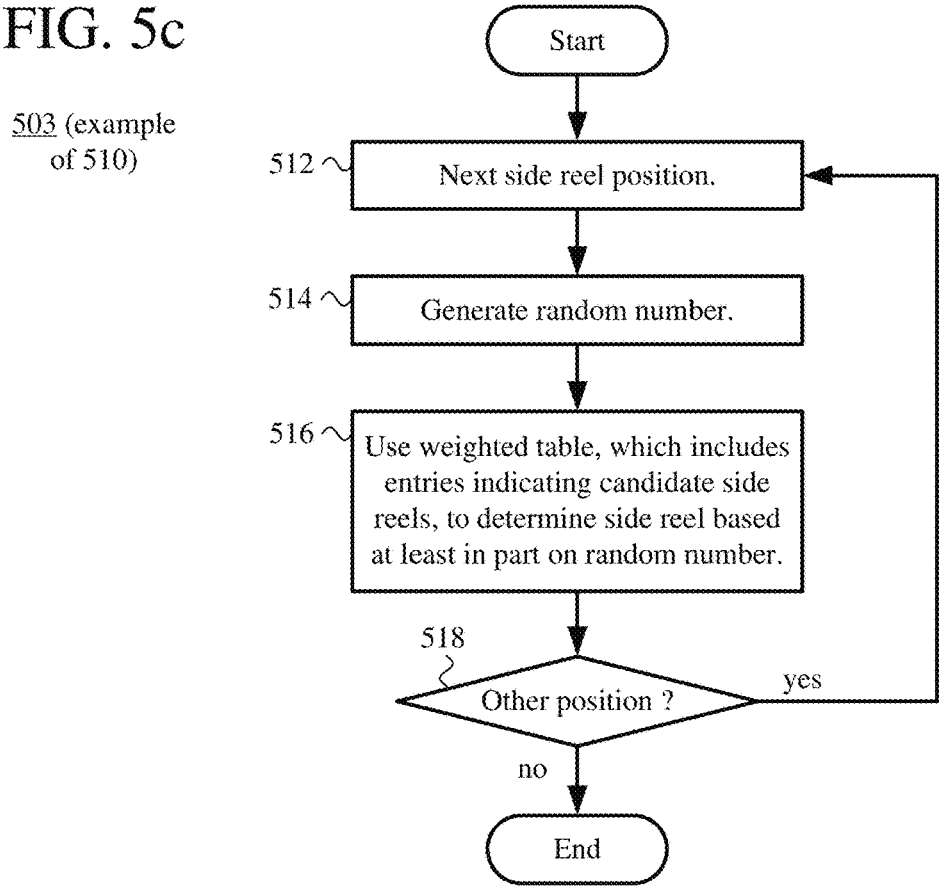
FIGS. 5*c*-5*i* are flowcharts illustrating example techniques for selected operations shown in FIGS. 5*a* and 5*b*, or other related operations.
Figure 5D:
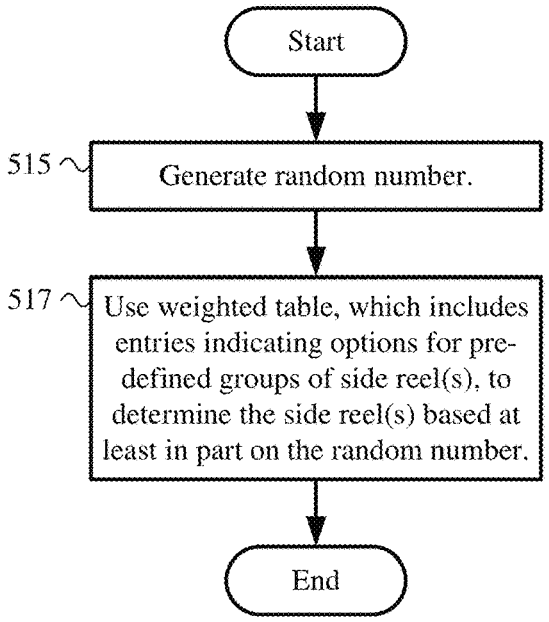
Figure 5E:
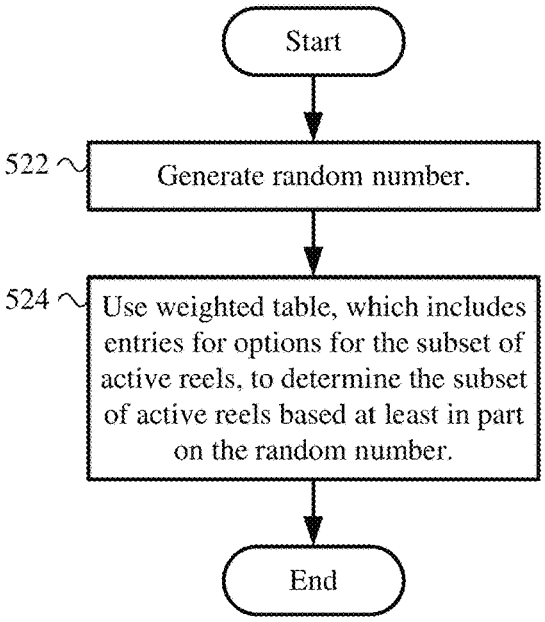
Figure 5F:
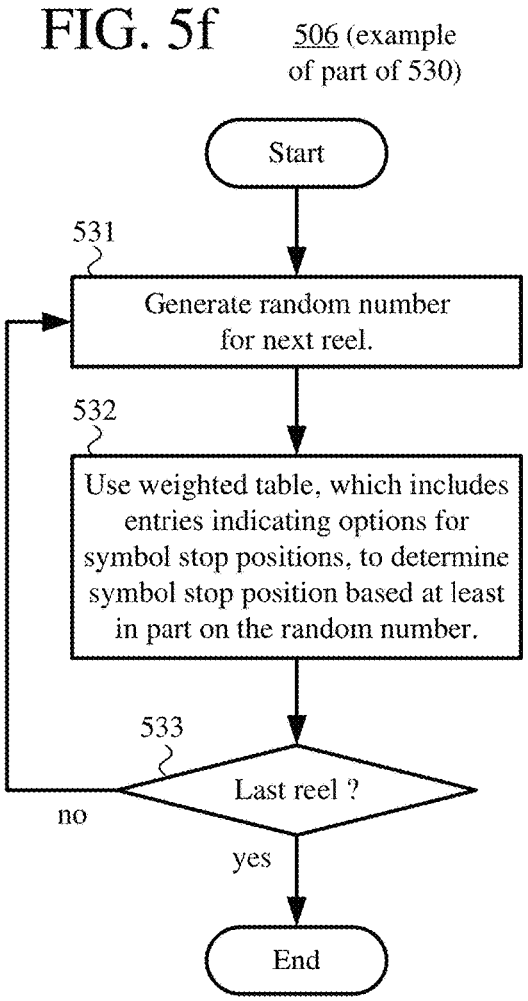
Figure 5G:
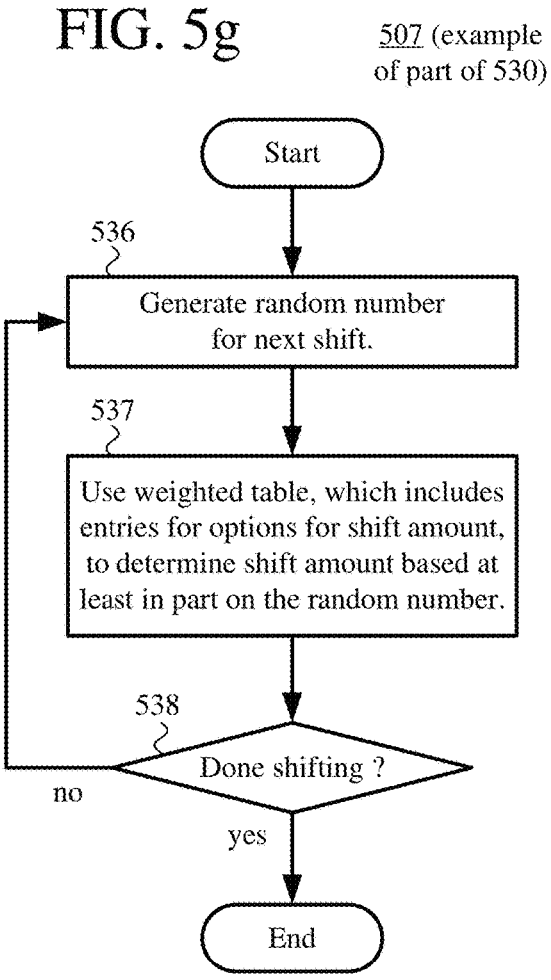
Figure 5H:
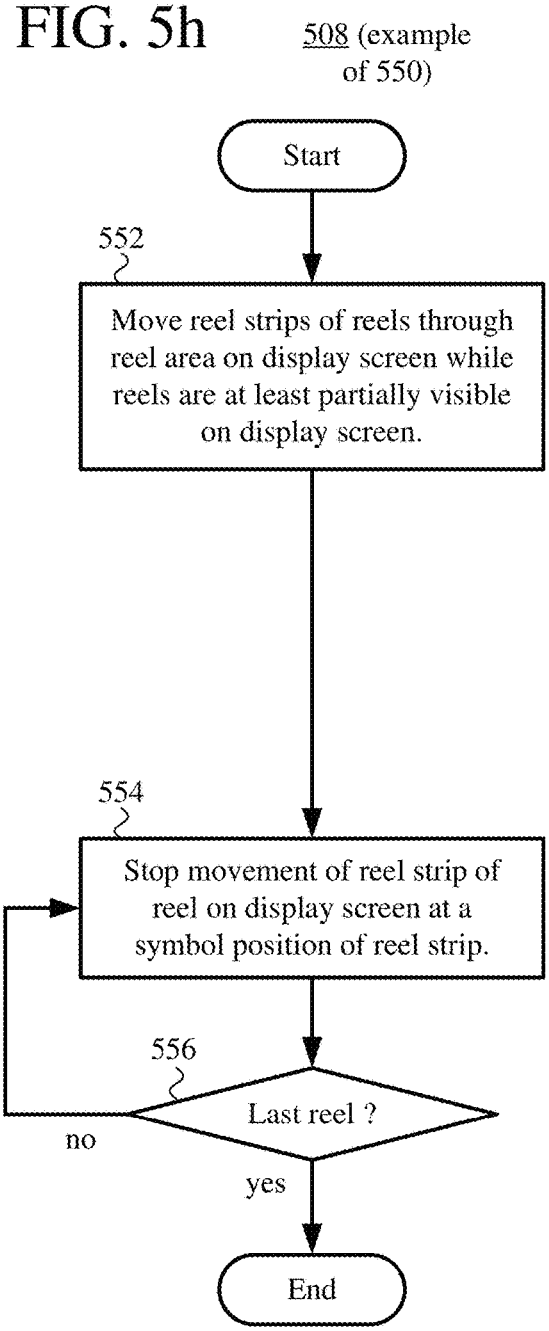
Figure 5I:
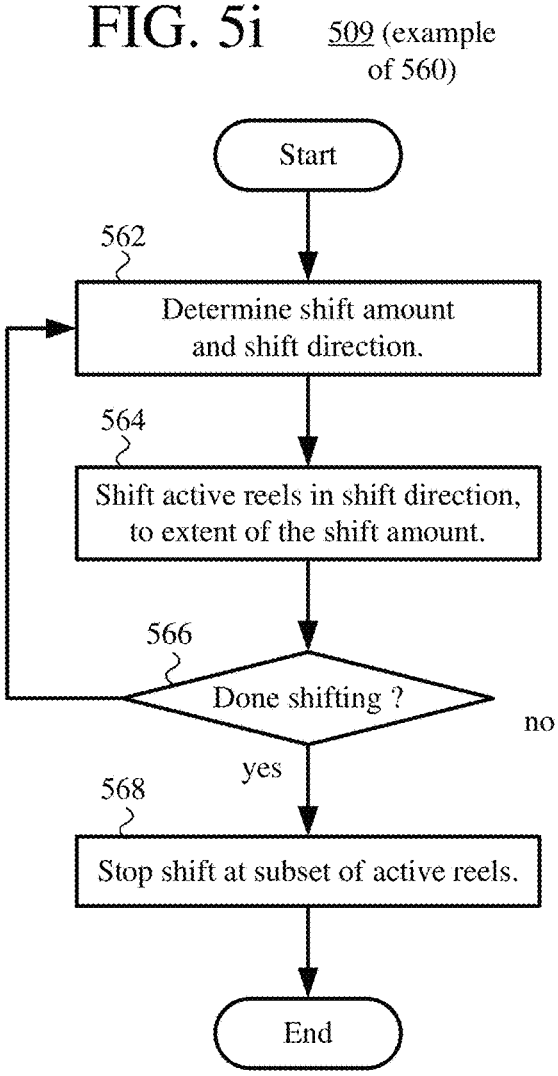
Figure 6:
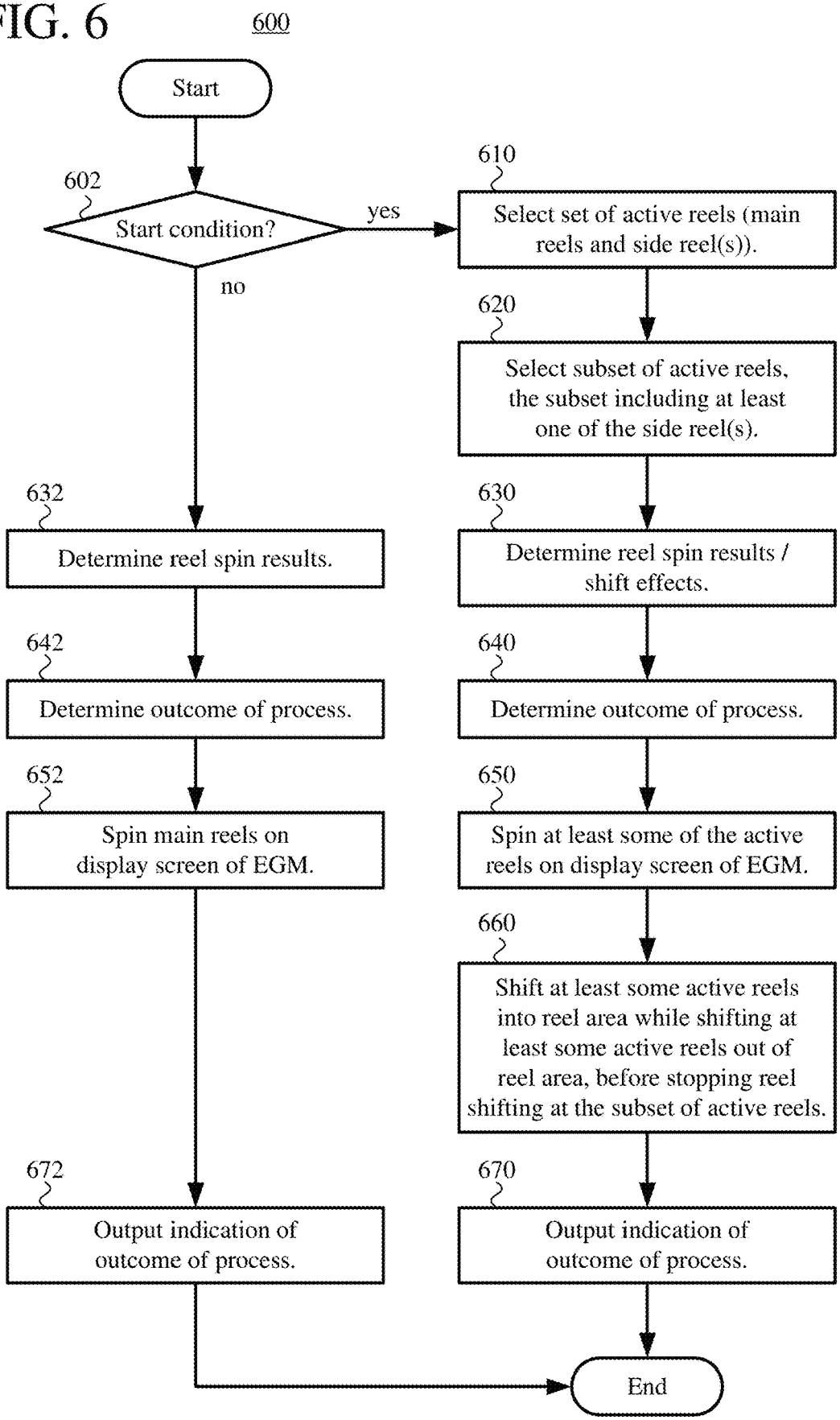
FIG. 6 is a flowchart illustrating an example technique for selectively shifting reels into and out of a reel area on a display screen of an electronic gaming device such as an EGM.

FIGS. 5*a*-5*i* and 6 show different aspects of controlling a user interface ("UI") of an electronic gaming device such as an electronic gaming machine ("EGM") to shift reels into and out of a reel area on a display screen of the electronic gaming device in a process. For example, the process is a mode of a base reel game or bonus reel game. The display screen can be the main display screen of the electronic gaming device or a secondary display screen. In particular, FIG. 5*a* shows an example technique 501 for shifting reels into and out of a reel area on a display screen of an electronic gaming device, from the perspective of a UI frontend. Operations of the example technique 501 shown in FIG. 5*a* can be performed, for example, in a UI system 302 explained with reference to FIG. 3. FIG. 5*b* shows an example technique 502 for shifting reels into and out of a reel area on a display screen of an electronic gaming device, from the perspective of a backend. Operations of the example technique 502 shown in FIG. 5*b* can be performed, for example, in a game processing backend system 314 explained with reference to FIG. 3. FIGS. 5*c*-5*i* show example techniques for selected operations shown in FIGS. 5*a* and 5*b*, which can, for example, be performed in a UI system 302 or game processing backend system 314, as appropriate. FIG. 6 shows an example technique 600 for selectively shifting reels into and out of a reel area on a display screen of an electronic gaming device such as an EGM. Some of the operations of the example technique 600 shown in FIG. 6 are performed, for example, in a UI system 302, while other operations of the example technique 600 are performed in a game processing backend system 314.

Control logic (such as a game controller 202 described with reference to FIG. 2) can perform the respective techniques shown in FIGS. 5*a*-5*i* and 6. The control logic can be implemented using memory and one or more processors that are part of the electronic gaming device and/or part of a gaming system located remotely from the electronic gaming device. For example, the control logic can be part of a UI system 302 and/or a game processing backend system 314. In general, the term "control logic" may refer to a game controller or, more generally, one or more processors, operable to process game play instructions in accordance with game play rules, determine outcomes in accordance with game play rules, and/or generate outputs (e.g., to one or more display screens and/or speakers). Depending on implementation, control logic can be implemented by software executable on a CPU, by software controlling special-purpose hardware (e.g., a GPU or other graphics hardware for video acceleration), and/or by special-purpose hardware (e.g., in an ASIC).

With reference to FIGS. 5*a* and 5*b*, the control logic can start the process (e.g., a mode of a base reel game or bonus reel game) in response to satisfaction of a start condition. In some example implementations, the start condition is checked after initiation of a play of a base reel game. The control logic can receive user input that indicates actuation of a button of the electronic gaming device (e.g., a "play" button or "spin" button), then check the start condition in response to actuation of the button of the electronic gaming device. For example, the start condition is a random event (e.g., randomly starting the process in x % of the plays of a base reel game). In this case, the start condition can be evaluated using a random number and weighted table (e.g., with a first entry defining an option for regular play and a second entry defining an option for the mode). Or, as another example, the start condition can be a configuration of special symbols in the reel area (e.g., a special combination of wild symbols or scatter symbols in a previous play). Alternatively, the start condition can be defined in some other way.

For the process, the reel area spans m reels in a first dimension and spans n symbols in a second dimension orthogonal to the first dimension. The value of m can be 1, 2, 3, 4, 5, 6, 7, 8, or some other number of reels. The value of n can be 2, 3, 4, 5, 6, or some other number of symbols. Typically, the m reels are arranged horizontally in the reel area from left-to-right, with the m reels spinning vertically and the reel area showing n symbols of each of the respective reels. Alternatively, the m reels are arranged vertically in the reel area from top-to-bottom, with the m reels spinning horizontally and the reel area showing n symbols of each of the respective reels. Also, instead of having the same value of n for all reels across the reel area, the reel area can have different numbers of symbols visible for different reels. Thus, the value of n can be different for different reels (e.g., n=3 for a leftmost reel, n=4 for a second reel, n=5 for a center reel, n=4 for a fourth reel, and n=3 for a rightmost reel).

With reference to FIG. 5*b*, at stage 510, the control logic selects a set of active reels for the process. Each of the active reels has an associated reel strip that is movable through the reel area on the display screen of the electronic gaming device upon a spin of the reel. The active reels include one or more main reels and one or more side reels.

The main reel(s) are the default reel(s) for the process. For example, when the process is a mode of a base reel game, the main reel(s) can be retained from the base reel game. The process uses m main reels, where m is 1, 2, 3, 4, 5, 6, 7, 8, or some other number.

The side reel(s) can include one or more first side reels on a first side of the main reel(s) as well as one or more second side reels on a second side of the main reel(s). The first side and second side can be opposite each other (e.g., left and right sides, or top and bottom sides), compared to the main reel(s). The active reels can be arranged from left to right, with the first side reel(s) being left of a leftmost one of the main reel(s), and with the second side reel(s) being right of a rightmost one of the main reel(s). Alternatively, the active reels can be arranged from top to bottom, with the first side reel(s) being above a topmost one of the main reel(s), and with the second side reel(s) being below a bottommost one of the main reel(s). For example, the process uses p first side reels and q second side reels, where p is 0, 1, 2, 3, 4, 5, 6, 7, or some other number, and where q is 0, 1, 2, 3, 4, 5, 6, 7, or some other number.

The side reel(s) can be selected from a set of candidate reels. Typically, a side reel includes different symbols than the main reel(s), or a side reel includes a greater proportion of valuable symbols compared to the main reel(s). For example, the set of candidate reels for the side reels includes (1) one or more reels of wild symbols, (2) one or more reels of special symbols (e.g., character symbols), (3) one or more reels of multiplier symbols; and/or (4) one or more reels that include a mixture of wild symbols, special symbols, and/or multiplier symbols. Thus, typical symbols of the side reel(s) make win conditions on pay lines more likely, compared to the typical symbols of the main reel(s).

When selecting the set of the active reels, the side reel(s) can be selected on a reel-by-reel-basis. For example, FIG. 5*c* shows an example technique 503 for selecting the set of active reels for stage 510. At stage 512, the control logic selects a next side reel position (e.g., left-side reel 1, left-side reel 2, and so on). At stage 514, the control logic generates a random number (e.g., using a gaming RNG 318 as described with reference to FIG. 3). Next, the control logic selects a side reel from the set of candidate reels based at least in part on the random number. In particular, at stage 516, the control logic uses a weighted table (which includes entries for candidate side reels) to determine a side reel based at least in part on the random number. At stage 518, the control logic checks whether to continue for another side reel position and, if so, selects the next side reel position (stage 512). In this way, the control logic can select a side reel to use at each side reel position. The control logic stores information indicating the set of active reels for use in later UI-focused operations.

Alternatively, when selecting the set of the active reels, the side reel(s) can be selected from multiple pre-defined groups of side reels. For example, FIG. 5*d* shows an alternative technique 504 for selecting the set of active reels for stage 510. At stage 515, the control logic generates a random number (e.g., using a gaming RNG 318 as described with reference to FIG. 3). Next, the control logic selects side reels to include in the set of active reels based at least in part on the random number. In particular, at stage 517, the control logic uses a weighted table (which includes entries indicating different pre-defined groups of side reels) to determine the combination of side reel(s) to use in the active reels, based at least in part on the random number. In this way, the control logic can select the combination of side reels to use in the active reels in a single lookup operation in the weighted table. The control logic stores information indicating the set of active reels for use in later UI-focused operations.

Alternatively, the control logic performs some other combination of operations to select the set of active reels at stage 510. For example, the control logic can select the active reels by loading a pre-determined configuration of active reels. In this case, the mode always uses the same side reel(s) as part of the set of active reels.

With reference to FIG. 5*b*, at stage 520, the control logic selects a subset of the active reels. Typically, the subset of active reels includes at least one of the side reel(s), but alternatively the subset can include only main reels. Typically, the subset of active reels includes adjacent ones of the active reels. For example, from a starting reel position, the subset of active reels includes one or more main reels and one or more side reels (or vice versa) in successive order. In some example implementations, to select the subset of the active reels, the control logic determines a final shift amount of the active reels away from an initial reel position of the main reel(s) (e.g., a final shift of one reel to the left, two reels to the left, three reels to the left, one reel to the right, two reels to the right, or three reels to the right).

FIG. 5*e* shows an example technique 505 for selecting the subset of the active reels. At stage 522, the control logic generates a random number (e.g., using a gaming RNG 318 as described with reference to FIG. 3). Next, the control logic determines the subset of the active reels based at least in part on the random number. In particular, at stage 524, the control logic uses a weighted table (which includes entries indicating different options for the subset of active reels) to determine the subset of the active reels, based at least in part on the random number. The subsets of the active reels can be represented as shift amounts relative to an initial reel position. The control logic stores information indicating the subset of active reels for use in later UI-focused operations.

Alternatively, the control logic performs some other combination of operations to select the subset of the active reels. For example, the selection of the subset of the active reels can be based at least in part on user input (e.g., to "steer" the shifting in a given direction to affect which of the active reels are selected as the subset).

With reference to FIG. 5*b*, at stage 530, the control logic determines reel spin results for the subset of active reels and determines shift effects for the process. In particular, the control logic determines symbol stop positions for at least those of the active reels that are visible in the reel area when shifting of the active reels stops. The control logic also determines the amount of reel shift for iterations of reel shifting, shift timing parameters, shift count parameters, and/or other shift effects.

FIG. 5*f* shows an example technique 506 for determining reel spin results for the subset of active reels, from the perspective of the backend system. The example technique 506 includes operations performed for each of the subset of active reels. At stage 531, the control logic generates a random number for a next reel (e.g., using a gaming RNG 318 as described with reference to FIG. 3). At stage 532, the control logic uses a weighted table (which includes entries indicating different options for symbol stop positions) to determine a symbol stop position for the reel based at least in part on the random number. At stage 533, the control logic checks whether to continue determining reel spin results for another reel. If so, the control logic continues by generating a random number (stage 531) for a next reel. The control logic stores the reel spin results (e.g., symbol stop positions) for the respective reels for use in later UI-focused operations. Alternatively, the control logic performs some other combination of operations to determine reel spin results (e.g., determining symbol stop positions for all of the active reels).

FIG. 5*g* shows an example technique 507 for determining shift effects, from the perspective of the backend system. For a given iteration of reel shifting, at stage 536, the control logic generates a random number (e.g., using a non-gaming RNG 319A . . . 319N as described with reference to FIG. 3). At stage 537, the control logic uses a weighted table (which includes entries indicating different options for shift amount) to determine a shift amount (e.g., a count of reels up to the number of side reels on a side) based at least in part on the random number. In this example, the shift direction alternates between iterations and is not randomly determined. At stage 538, the control logic checks whether to stop the reel shifting operations. The reel shifting operations can stop after a pre-defined number of iterations of reel shifting or after a randomly selected number of iterations of reel shifting (e.g., with a stop becoming more likely after each iteration of reel shifting or after a threshold number of iterations of reel shifting has been reached). If the reel shifting operations continue, the control logic generates a random number (stage 536) for the next iteration of reel shifting. The control logic stores information that indicates shift effects for use in later UI-focused operations.

Alternatively, the control logic performs some other combination of operations to determine shift effects (e.g., also determining a count of shift iterations based on a random number and/or determining shift timing parameters based on random numbers; or using pre-defined shift effects that are not based on random numbers). Shift direction can be randomly selected for an initial iteration, then alternate between successive iterations. Or, shift direction can follow a pre-selected order.

Although FIG. 5*b* shows a single stage 530 that includes determining reel spin results and shift effects, alternatively, reel spin results and shift effects can be determined in separate stages. In particular, shift effects can be determined later, as needed during UI-focused operations. Also, to the extent the shift effects do not affect the outcome of the process, the shift effects can be determined using a non-gaming RNG 319A . . . 319N, as described with reference to FIG. 3, instead of a gaming RNG 318.

With reference to FIG. 5*b*, at stage 540, the control logic determines an outcome of the process. For example, the control logic sets an amount that depends on presence of win conditions on pay lines through the subset of the active reels. This can include pay lines that pass through symbols (e.g., wild symbols, special symbols, multiplier symbols) of at least one side reel in the subset of active reels. The selected subset of the active reels in the reel array are arranged from side to side (e.g., left to right). When determining an award amount for a pay line through the subset of the active reels, the order of the reels may be considered. Alternatively, the control logic determines the outcome of the process in some other way. For example, the control logic sets an amount according to a "ways" approach that considers possible paths through symbols in the reel area for the subset of the active reels, possibly considering which of the reels have been selected or not selected, and possibly considering the order of the reels. In any case, the control logic stores information indicating the outcome for use in later UI-focused operations.

With reference to FIG. 5*a*, at stage 550, the control logic spins at least some of the set of the active reels on the display screen. The control logic can receive user input that indicates actuation of a button of the electronic gaming device (e.g., a "play" button or "spin" button), then (after determination of the active reels, subset of active reels, reel spin results, etc. as described with reference to FIG. 5*b*), initiate the spinning of the at least some of the set of the active reels in response to actuation of the button of the electronic gaming device. During the spinning of the active reels, the side reel(s) can spin at the same speed as the main reel(s). Or, the side reel(s) can spin at a different speed than the main reel(s) (e.g., slower than the main reel(s)). Different side reels can move at different speeds (e.g., slower for side reels further from main reel(s)). Of course, the spinning of a reel slows down before that reel lands (stops) in the reel area.

FIG. 5*h* shows an example technique 508 for spinning the at least some of the set of the active reels on the display screen, from the perspective of the UI frontend. The example technique 508 includes operations performed for each of the at least some of the set of the active reels. At stage 552, the control logic moves the reel strips of the reels through the reel area on the display screen while the reels are at least partially visible on the display screen. At stage 554, the control logic stops the movement of the reel strip of a reel on the display screen at a symbol position of the reel strip (the symbol stop position). Alternatively, the control logic performs some other combination of operations to spin the at least some of the set of the active reels on the display screen. Eventually (e.g., after shifting operations have finished), the spinning of the active reels stops. The spinning of the reels can stop for successive reels visible in the reel area (e.g., with reels successively stopping from left to right in the reel area).

With reference to FIG. 5*a*, at stage 560, the control logic shifts at least some of the active reels into the reel area while shifting at least some of the active reels out of the reel area. Eventually, the control logic stops the reel shifting at the subset of the active reels. Typically, the control logic changes the shift direction (e.g., between shifting left and shifting right) at least one time before stopping the reel shifting of the active reels. Also, the control logic typically reaches each end of the active reels on the display screen at least one time, so as to "show" all of the side reels to the user, before the reel shifting of the active reels stops.

FIG. 5*i* shows an example technique 509 for shifting active reels into/out of the reel area, from the perspective of the UI frontend. The example technique 509 includes operations performed in iterations of reel shifting.

With reference to FIG. 5*i*, for a given iteration of reel shifting, at stage 562, the control logic determines a shift amount and shift direction for the iteration. For example, the shift amount is a count of reels (such as 1, 2, 3, etc., up to the number of side reels on a side). The shift amount can be randomly selected for an iteration, as described with reference to FIG. 5*g*. Or, the shift amount can start at a highest value for an initial iteration for each side, then randomly stay the same or decrease in subsequent iterations. Or, the shift amount can follow a pre-selected order of shift amounts. The shift direction can be randomly selected for an initial iteration (by a backend system), then alternate between successive iterations (e.g., left then right, or vice versa). Or, the shift direction can follow a pre-selected order.

At stage 564, the control logic shifts the active reels in the shift direction, to the extent of the shift amount, for the iteration of reel shifting. In this way, at least some of the active reels are shifted into the reel area, and at least some of the active reels are shifted out of the reel area, for the iteration of reel shifting. In practice, the shifting of the active reels is animated on the display screen. During the shifting of the active reels, one or more other graphics can be rendered to emphasize the shifting of the active reels. For example, a background image or animation "behind" the active reels (that is, a background image or animation onto which the active reels are overlaid) can shift to indicate the direction of the reel shifting. Or, as another example, a graphic depicting a steering wheel, horizon indicator, flight stick, handlebars, hand, or other control mechanism or instrument can be tilted, rotated, or otherwise moved on the display screen to emphasize the reel shifting, potentially also indicating the direction of the reel shifting. The graphic can be adjacent the reel area or located elsewhere on a display screen.

At stage 566, the control logic checks whether to stop the reel shifting operations. The reel shifting operations can stop after a pre-defined number of iterations of reel shifting or after a randomly selected number of iterations of reel shifting (selected by the backend system). If the reel shifting operations continue, the control logic determines a shift amount and shift direction (stage 562) for the next iteration of reel shifting. Otherwise, at stage 568, the control logic stops the shifting of the active reels at the selected subset of the active reels in the reel area. In some example implementations, after the control logic stops the shifting of the active reels at the selected subset of the active reels in the reel area, the control logic begins to stop the spinning of those of the active reels that are in the subset of active reels, so that the active reels in the subset land (stop) in the reel area.

Alternatively, the control logic performs some other combination of operations to shift active reels into/out of the reel area. For example, the control logic shift active reels into/out of the reel area according to a pre-defined pattern of shift amounts and shift directions. Or, the control logic shifts active reels into/out of the reel area according to a pattern of shift amounts and shift directions selected (by the backend system) from multiple available patterns. The shifting of the active reels into/out of the reel area can be characterized as a camera view (from the perspective of a user) panning from side to side over the set of active reels overlaid on a background image or animation. As the camera view pans to the right, active reels shift to the left through the reel area. As the camera view pans to the left, active reels shift to the right through the reel area.

At stage 570, the control logic outputs an indication of the outcome of the process. For example, when the display screen is a main display screen, the control logic renders a graphic (e.g., image, animation) that indicates the outcome of the process on the main display screen or a secondary display screen of the electronic gaming device.

Although FIGS. 5*a* and 5*b* show stages 510, 520, 530, and 540 in a series, and show stages 550, 560, and 570 in a separate series, the control logic can perform operations for some or all of these stages concurrently. For example, the control logic can perform stages 510 and 520 concurrently using a single weighted table (as described with reference to FIG. 7). As another example, the control logic can select the set of active reels (stage 510), select a subset of the active reels (stage 520), determine reel spin results and shift effects (stage 530), start the spinning of the active reels (stage 550), start the shifting of the active reels (stage 560), stop the shifting of the active reels at the selected subset (stage 550), and stop the spinning of the active reels (stage 560). Thus, the shifting of the active reels into and out of the reel area can happen during the spinning of active reels. Or, as another example, the control logic can select the set of active reels (stage 510), start the spinning of the active reels (stage 550), determine shift effects (stage 530), start the shifting of the active reels (stage 560), select a subset of the active reels (stage 520) and determine reel spin results (stage 530), stop the shifting of the active reels at the selected subset (stage 560), and stop the spinning of the active reels (stage 550). Or, as another example, the control logic can select the set of active reels (stage 510), select a subset of the active reels (stage 520), determine reel spin results and shift effects (stage 530), start the shifting of the active reels (stage 560), stop the shifting of the active reels at the selected subset (stage 560), start the spinning of the active reels (stage 550), and stop the spinning of the active reels (stage 550). Thus, the shifting of the active reels into and out of the reel area can happen before the spinning of active reels starts. Alternatively, the control logic can perform operations for some or all of stages 510-570 in some other different order.

FIG. 6 shows an example technique for selectively shifting reels into and out of a reel area on a display screen of an electronic gaming device such as an EGM, combining UI frontend operations and backend operations. In the example shown in FIG. 6, the reel shifting operations are performed as part of a special mode but not as part of regular play.

At stage 602, the control logic checks whether a start condition is satisfied. The start condition can be checked at pre-defined time, e.g., upon a "spin" or other activation of a base reel game. The start condition can depend on a random event. For example, the control logic generates a random number, then uses a weighted table (with entries defining one or more options for regular play and one or more options for the special mode) to determine whether the start condition is satisfied based at least in part on the random number. Alternatively, the start condition can be a configuration of special symbols in the reel area (e.g., a special combination of wild symbols or scatter symbols in a previous play). Alternatively, the start condition can be defined in some other way.

If the start condition is satisfied, the control logic starts the process for the special mode. At stage 610, the control logic selects a set of active reels, for example, as described with reference to stage 510 of FIG. 5*b*. At stage 620, the control logic selects a subset of the active reels, for example, as described with reference to stage 520 of FIG. 5*b*. At stage 630, the control logic determines reel spin results and shift effects, for example, as described with reference to stage 530 of FIG. 5*b*. At stage 640, the control logic determines an outcome of the process, for example, as described with reference to stage 540 of FIG. 5*b*. At stage 650, the control logic spins at least some of the set of the active reels on the display screen, for example, as described with reference to stage 550 of FIG. 5*a*. At stage 660, the control logic shifts at least some of the active reels into a reel area while shifting at least some of the active reels out of the reel area, before stopping at the subset of active reels, for example, as described with reference to stage 560 of FIG. 5*a*. Finally, at stage 670, the control logic outputs an indication of the outcome of the process, for example, as described with reference to stage 570 of FIG. 5*a*.

Otherwise (start condition not satisfied), the control logic performs operations for a regular mode. At stage 632, the control logic determines reel spin results for the main reels. For example, the control logic determines reel spin results for the respective main reels like it determines reel spin results generally as described with reference to stage 530 of FIG. 5*b*. At stage 642, the control logic determines an outcome of the process, for example, generally as described with reference to stage 540 of FIG. 5*b*. At stage 652, the control logic spins the main reels on the display screen. For example, the control logic spins the respective main reels like it spins reels generally as described with reference to stage 550 of FIG. 5*a*. Finally, at stage 672, the control logic outputs an indication of the outcome of the process, for example, generally as described with reference to stage 570 of FIG. 5*a*.

IV. Example Weighted Tables.

FIG. 3 shows examples of lookup tables 322A . . . 322N, which are also called weighted tables. In general, a weighted table can be implemented as any data structure that assigns probabilities to different options, in order for one of the different options to be selected using a random number. Different options are represented in different entries of a weighted table. The probabilities for different options can be reflected in threshold values (e.g., 1<RND<=40 for option 1, 40<RND<=70 for option 2, 70<RND<=90 for option 3, and 90<RND<=100 for option 4, given four options and a random number RND where 0<RND<=100). The threshold values can represent percentages or, more generally, subranges within the range for a random number. In some example implementations, the threshold values for a weighted table are represented as count values for the respective entries of the weighted table. For example, the following table shows count values for the four options described above:

TABLE 1

| Example Weighted Table | |
|---|---|
| count value | entry |
| 40 | <value a1, value a2, . . . > |
| 30 | <value b1, value b2, . . . > |
| 20 | <value c1, value c2, . . . > |
| 10 | <value d1, value d2, . . . > |

The sum total of the count values indicates the range of the options. Control logic can use a random number, generated between 1 and the sum total of the count values, to select one of the entries in the weighted table by comparing the random number to successive running totals. In the example shown in Table 1, if the random number is 40 or less, the first entry is selected. Otherwise, if the random number is between 41 and 70, the second entry is selected. Otherwise, if the random number is between 71 and 90, the third entry is selected. Otherwise, the last entry is selected.

The threshold values for a weighted table can be fixed and pre-determined. Or, the threshold values for a weighted table can vary dynamically (e.g., depending on bet level). Or, a weighted table can be dynamically selected (e.g., depending on bet level) from among multiple available weighted tables. Different parameters or choices during game play can use different weighted tables. Or, different combinations of parameters or choices can be combined in entries of a given weighted table.

FIG. 7 is a code listing 700 that includes two example weighted tables 710, 720. Each of the example weighted tables 710, 720 includes multiple entries. Each entry includes a count, which corresponds to the weight given to that entry compared to all of the entries of the weighted table. A lower count (smaller weight) indicates a less likely option. A higher count (larger weight) indicates a more likely option. The counts depend on implementation.

In FIG. 7, a first weighted table 710 (named FuryRoad-Triggered) includes entries that indicate whether a start condition for a special mode is satisfied (true) or not satisfied (false). Each entry of the first weighted table 710 includes a count 711 and corresponding value 712, which is a single Boolean value. The count for the first entry (whose corresponding value is true) is 1. The count for the second entry (whose corresponding value is false) is 364. The sum of the counts is 365. The control logic can generate a random number RND between 1 and 365, then use the weighted table 710 to determine whether the start condition is satisfied. For example, the first entry (true) is selected if RND==1 but the second entry (false) is selected if 2<=RND<=365.

In FIG. 7, a second weighted table 720 (named FuryRoadReels) includes entries that indicate different combinations of options for side reels (to include in a set of active reels), the subset of active reels at which reel shifting operations stop, and the extent of reel shifting operations. Each entry of the second weighted table 720 includes a count 721 and corresponding value 722, which is a string of characters. The count for the first entry is 19875, the count for the second entry is 24682, the count for the third entry is 10526, and so on. The sum of the counts is 180442. The control logic can generate a random number RND between 1 and 180442, then use the weighted table 720 to select one of the entries of the second weighted table 720.

In FIG. 7, each entry of the second weighted table 720 includes, as part of the value 722, ten pairs of characters, separated by spaces, that indicate side reels to include in a set of active reels. The character pair WI indicates a side reel that includes all wild symbols. The character pair X2, X3, or X4 indicates a side reel that includes all multiplier symbols of a given value (e.g., 2×, 3×, or 4×). The character pair P1 or P2 indicates a side reel that includes all special symbols (e.g., game character symbols). Alternatively, the side reels can include other symbols. Although FIG. 7 shows the same count of side reels in all entries of the second weighted table 720, alternatively different entries can indicate different counts of side reels.

Each entry of the second weighted table 720 also includes, as part of the value 722, a pair of characters that indicates a final landing position (final shift amount) for reel shifting the active reels (i.e., the subset of active reels at which shifting stops). For the sake of simplicity, the second weighted table 720 shown in FIG. 7 includes only two different options for the final landing position for shifting of the active reels—the character pair L1 indicates a final landing position for shifting the active reels at the first left-side reel, and the character pair R5 indicates a final landing position for shifting the active reels at the fifth right-side reel. Alternatively, the value 722 can indicate other final landing positions for the subset of active reels, e.g., second, third, fourth, or fifth left-side reel, or first, second, third, or fourth right-side reel.

Finally, each entry of the second weighted table 720 includes, as part of the value 722, a number that indicates a maximum extent of reel shifting to the left and a number that indicates a maximum extent of reel shifting to the right. In FIG. 7, the maximum extent of reel shifting is 3 or 5 in each direction, depending on the entry. Alternatively, the maximum extent of reel shifting can have some other number. The maximum extent of reel shifting can be the same or different in different directions. One or more other decisions that affect how reel shifting operations are performed (e.g., an overall count of iterations for the reel shifting operations; extent of reel shifting/shift amount for each iteration of reel shifting; hold time and/or acceleration in animation of reel shifting operations for each iteration of reel shifting) can also be represented in entries of one or more weighted tables.

In the second weighted table 720 shown in FIG. 7, each entry includes, as part of its value 722, indicators for multiple decisions. Alternatively, different weighted tables can be used for different decisions. For example, a separate weighted table can be used to determine the final landing position (final shift amount) for reel shifting the active reels (i.e., the subset of active reels at which shifting stops). For the side reels to include in the set of active reels, a separate weighted table can include entries for different pre-defined combinations of side reels. Or, one weighted table can be used to determine a number of side reels (overall, or on each side), and another weighted table can be used to determine which symbols (or candidate side reel) to use for a given side reel. One or more other weighted tables can include entries that control how shifting operations are performed in different iterations of reel shifting.

V. Example Screenshots when Shifting Side Reels into/Out of a Reel Area.

FIGS. 8*a*-8*m* are diagrams that represent example screen shots of a display screen of an electronic gaming device such as an EGM for a special mode of a base reel game, according to some example implementations. The example screen shots represent time instances of game play of the base reel game, from the start of operations to shift side reels through the determination of an award for a play of the base reel game.

In FIGS. 8*a*-8*m*, the display screen 802 includes a reel area 804. The reel area 804 spans five reels horizontally and spans three symbols vertically. The set of active reels includes three left-side reels 831-833, five main reels 811-815, and three right-side reels 821-823, but the reel area 804 shows symbols for no more than five complete reels at a time. At any given time, visible reels among the active reels 811-815, 821-823, or 831-833 are overlaid (composited) on an animated background graphic 806, which can change during the sequence shown in FIGS. 8*a*-8*m*. In addition, the display screen 802 can appear to shake to simulate bumpy movement. A border area 808 can include an animated wheel graphic, which can be overlaid (composited) on the bottom of the reel area and bottom portion of the display screen 802. The animated wheel graphic can change during the sequence shown in FIGS. 8*a*-8*m*, to emphasize the shifting of the active reels into/out of the reel area 804. The border area 808 can also display supplemental information such as a base denomination for the game, a current bet level, and credits available to the user.

For the sake of simplicity, FIGS. 8*a*-8*m* show symbols of the active reels 811-815, 821-823, or 831-833 exactly aligned in the reel area 804, even as reels spin and shift into/out of the reel area 804. In practice, as a reel spins, its symbols vertically shift into/out of the reel area 804, and in many instances symbols are only partially within the reel area 804. Similarly, as the active reels horizontally shift into/out of the reel area 804, in many instances reels are only partially within the reel area 804.

Figure 8A:
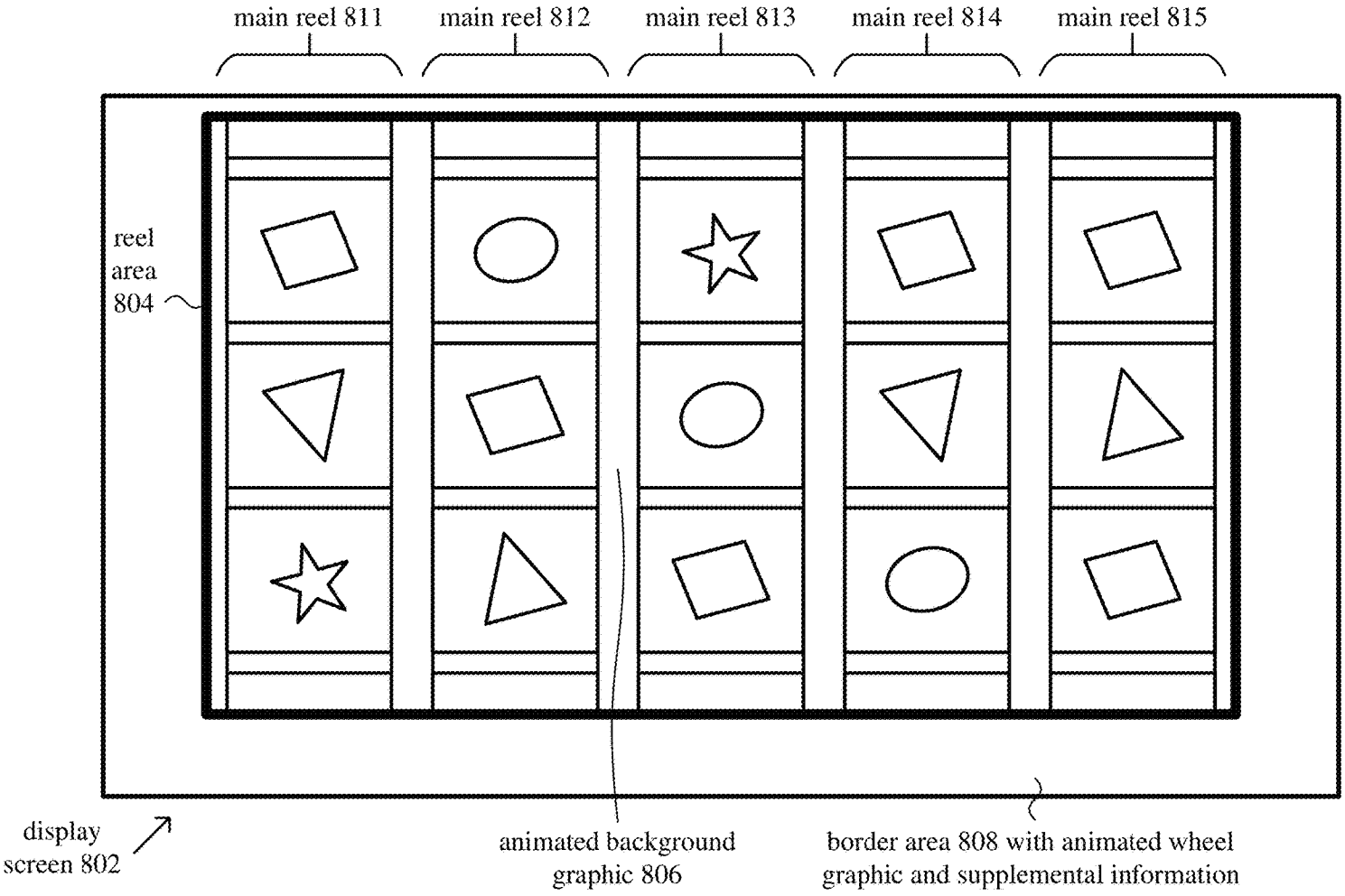

As shown in FIG. 8*a*, the reel area 804 initially includes the five main reels 811-815 of the base reel game. In the example shown in FIG. 8*a*, the main reels 811-815 are already spinning.

Figure 8B:
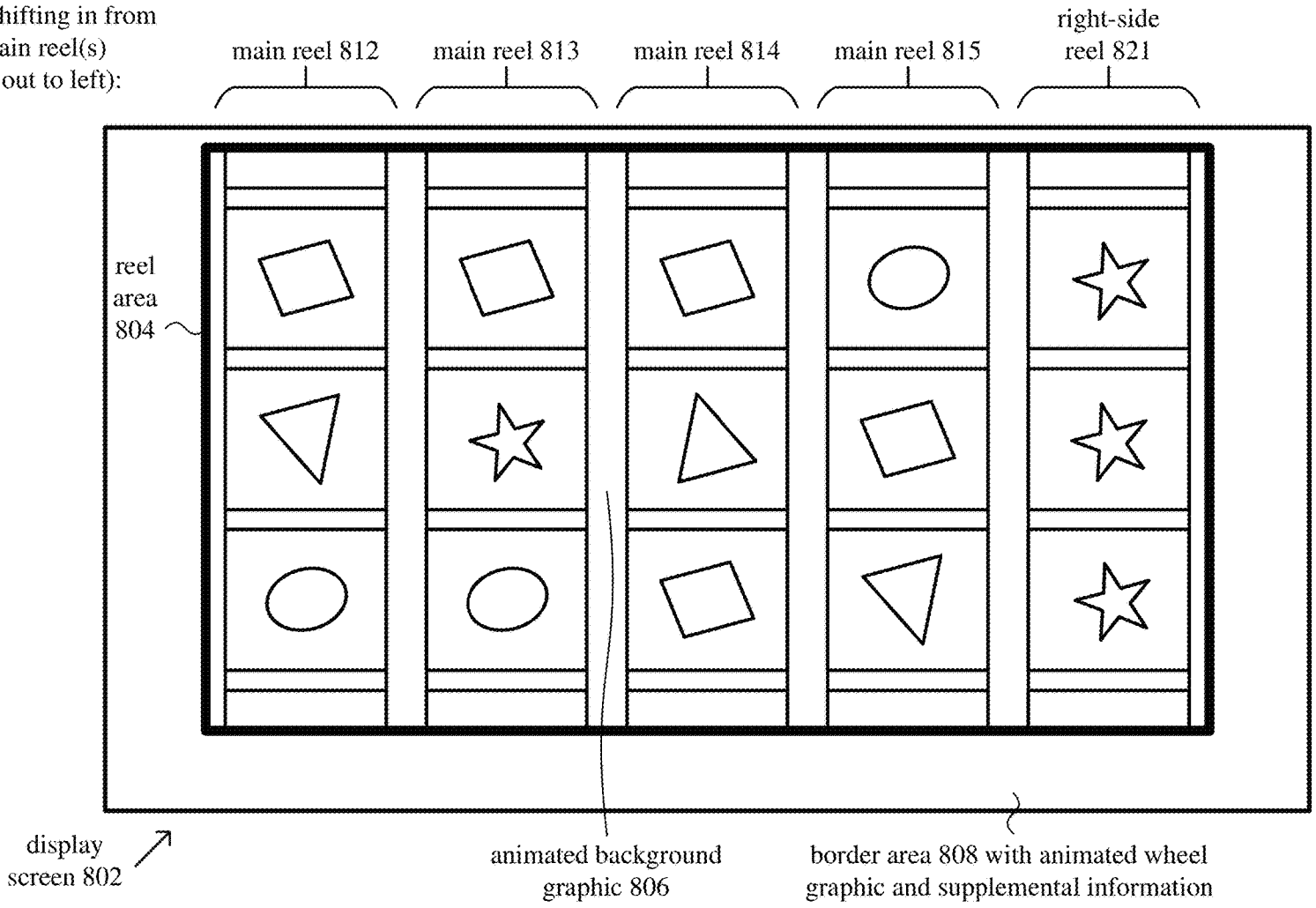
Figure 8C:
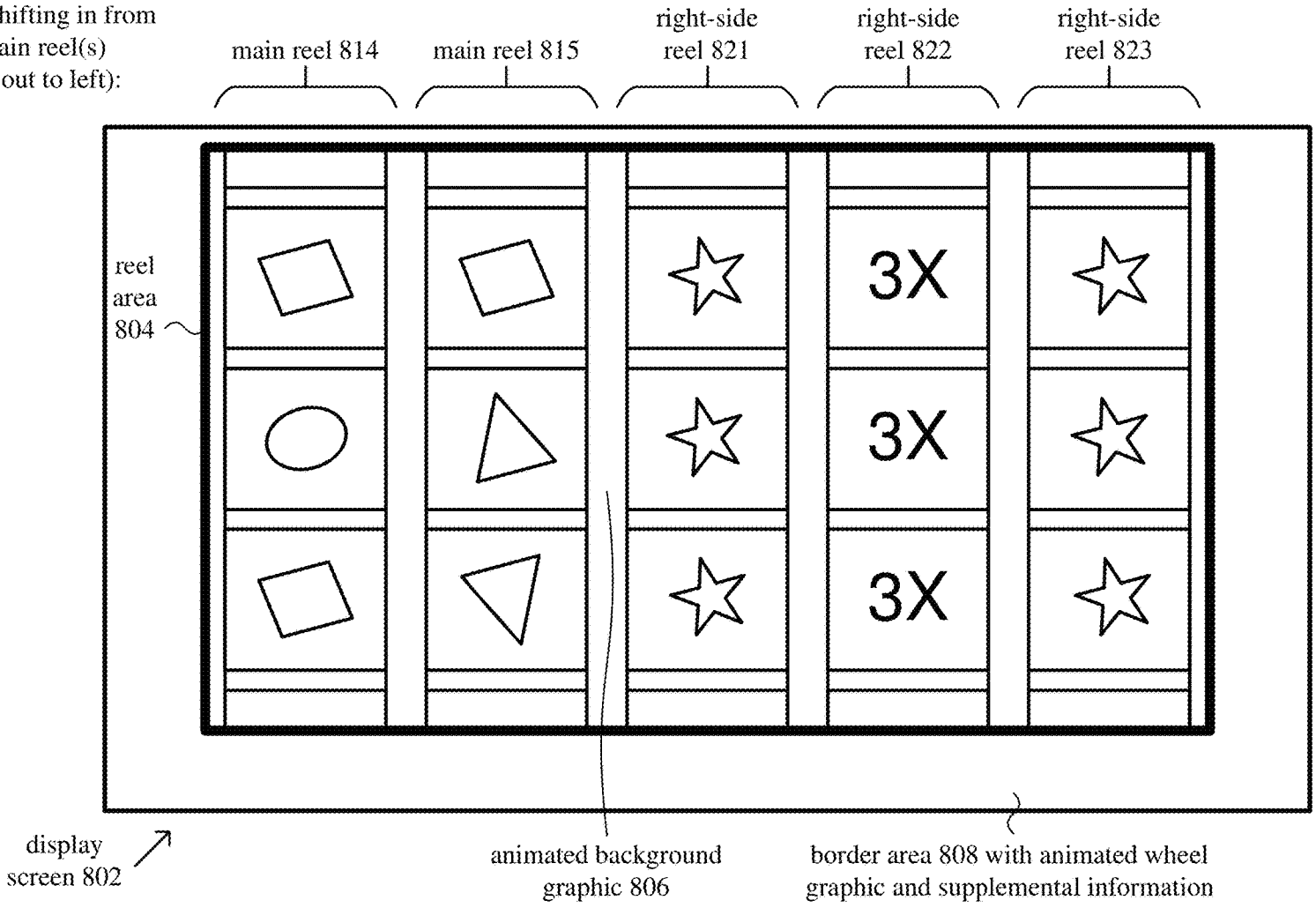

From FIGS. 8*b*-8*c*, the active reels gradually shift to the left on the display screen 802. In FIG. 8*b*, a right-side reel 821 that was "off screen" to the right of the reel area 804 in FIG. 8*a* has shifted into the reel area 804, and a main reel 811 from the reel area 804 in FIG. 8*a* has shifted "off screen" to the left of the reel area 804. In FIG. 8*c*, three main reels 811-813 have shifted out of the reel area 804, and three right-side reels 821-823 have shifted into the reel area 804. At the furthest extent shown in FIG. 8*c*, the reel area 804 encloses two main reels 814, 815 and three right-side reels 821-823. Concurrently, the background graphic 806 can shift sideways (panning to the right), so as to emphasize the direction of the shifting of the active reels, and the animated steering wheel graphic can spin. The shifting of the active reels on the display screen 802 can be characterized as a camera view (from the perspective of the player, of the active reels overlaid on the background graphic 806) panning to the right in FIGS. 8*b*-8*c*. Throughout the shifting operations in FIGS. 8*b*-8*c*, the active reels (at least the ones visible on the display screen) continue to spin.

Figure 8D:
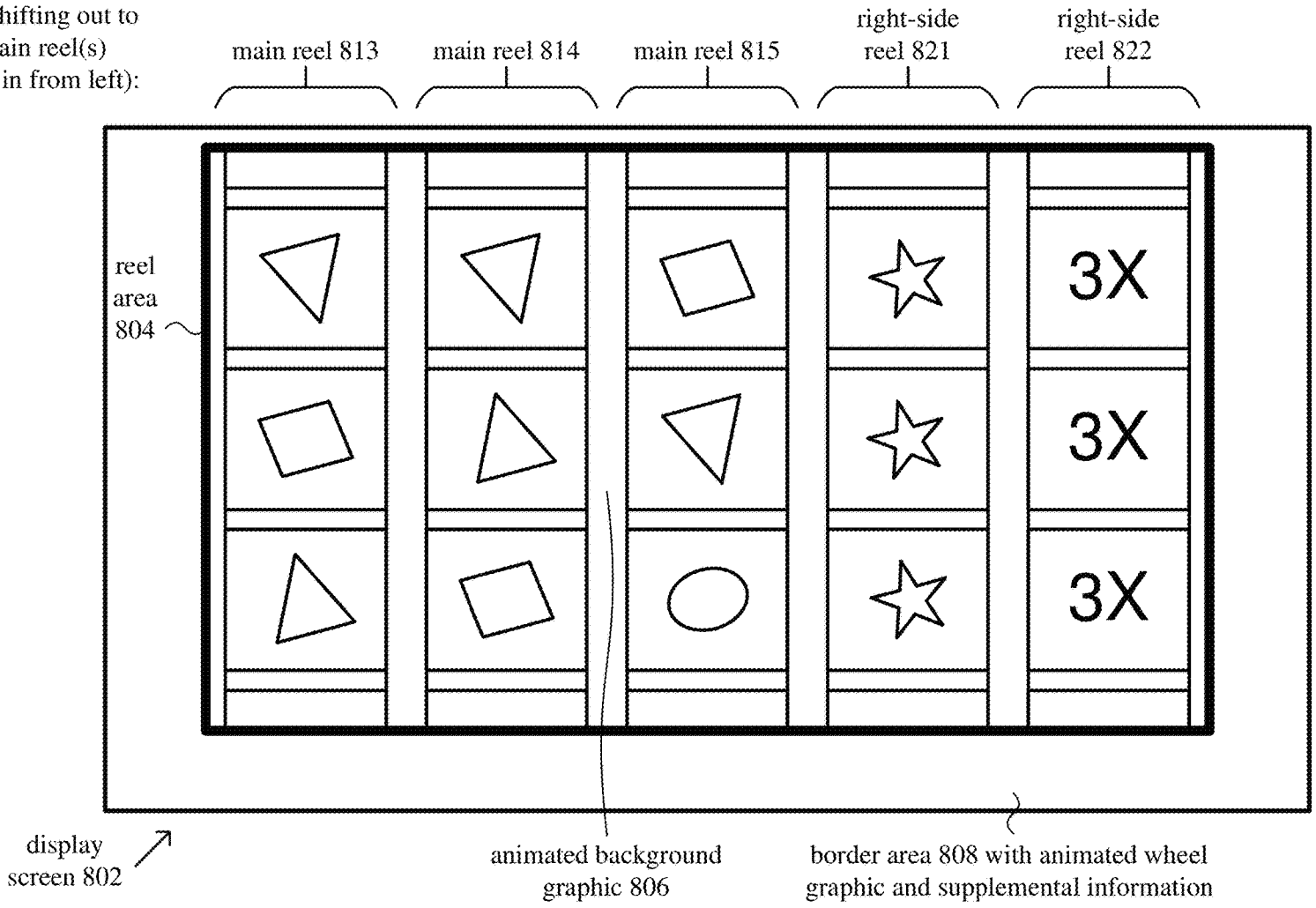
Figure 8E:
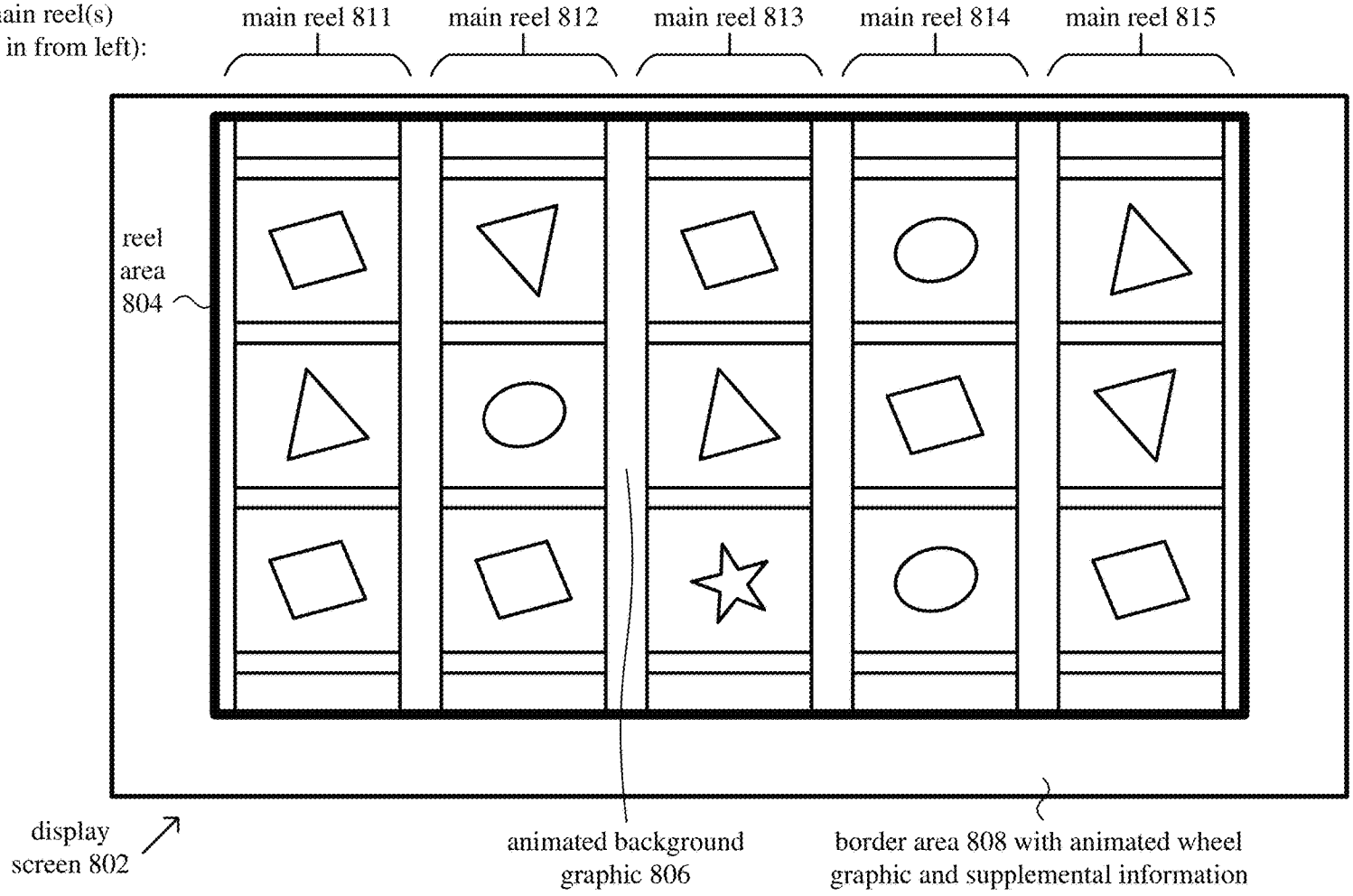
Figure 8F:
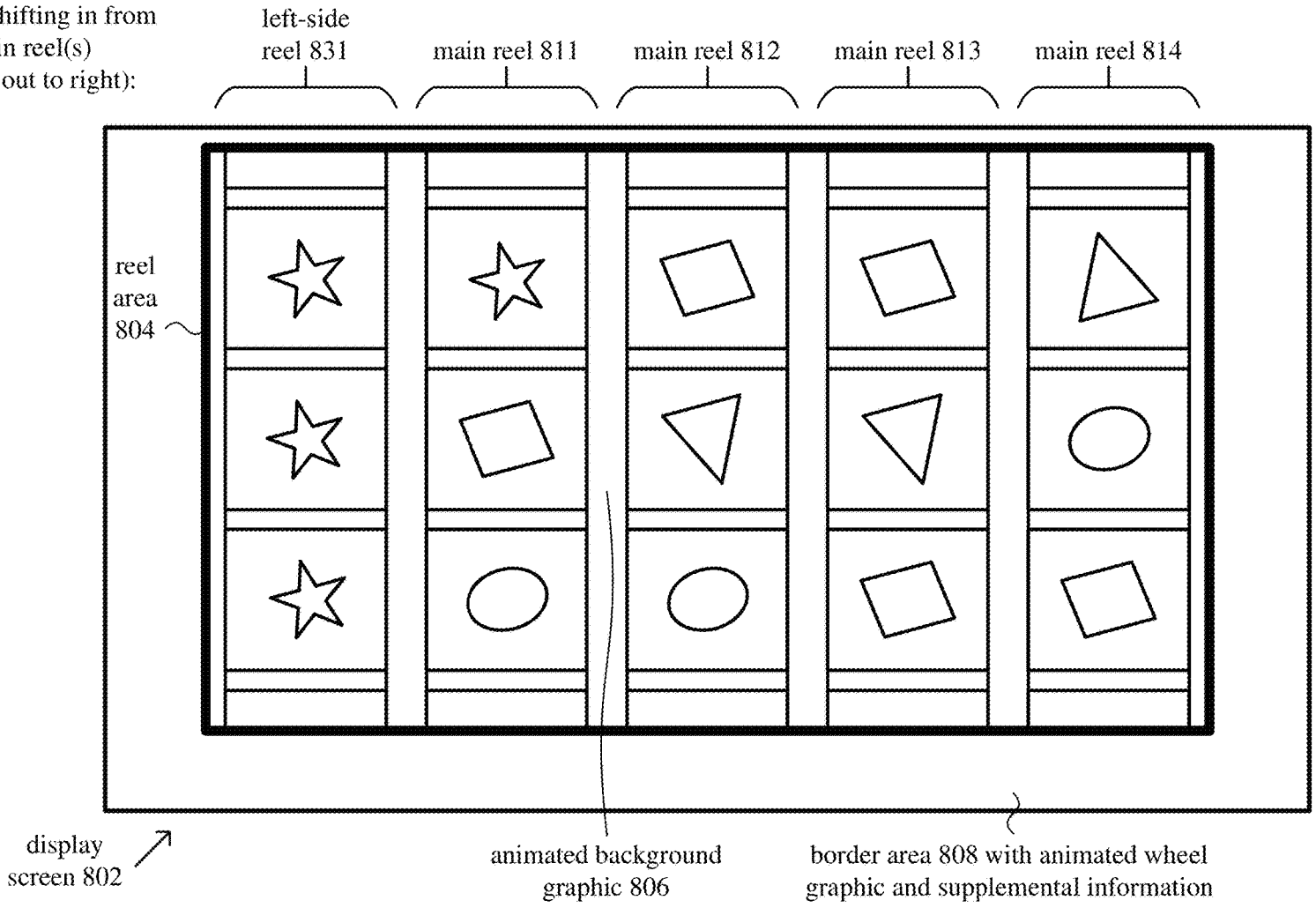
Figure 8G:
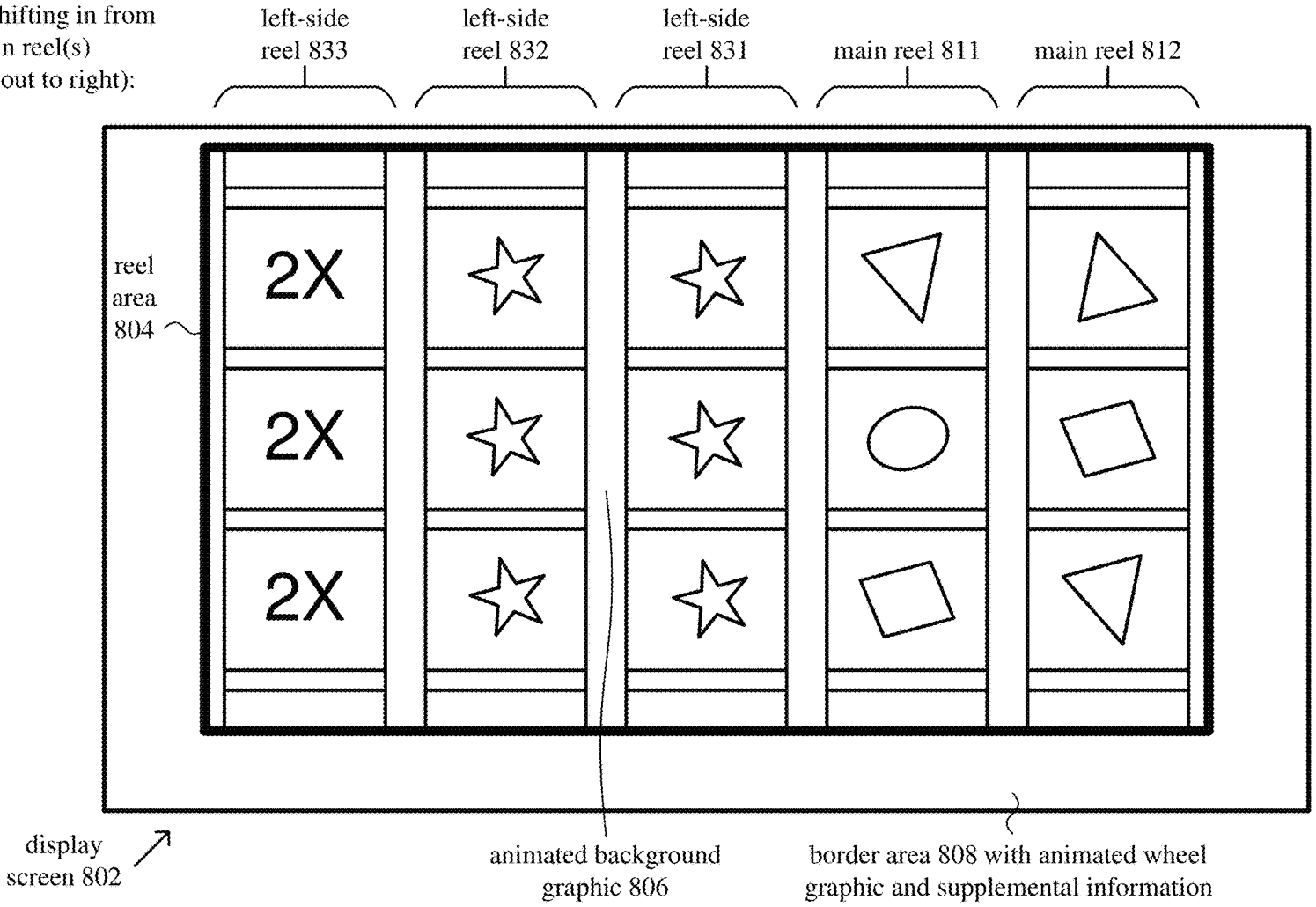

From FIGS. 8*d*-8*g*, the active reels gradually shift to the right on the display screen 802. In FIG. 8*d*, a main reel 813 that was "off screen" to the left of the reel area 804 in FIG. 8*c* has shifted into the reel area 804, and a right-side reel 823 from the reel area 804 in FIG. 8*c* has shifted "off screen" to the right of the reel area 804. In successive figures from FIGS. 8*d*-8*g*, the three right-side reels 821-823 and main reels 813-815 gradually shift out of the reel area 804, and the other main reels 811, 812 and left-side reels 831-833 gradually shift into the reel area 804. At the furthest extent shown in FIG. 8*g*, the reel area 804 encloses three left-side reels 831-833 and two main reels 811, 812. From FIGS. 8*d*-8*g*, the background graphic can shift sideways (panning to the left), so as to emphasize the direction of the shifting of the active reels, and the animated steering wheel graphic can spin. The shifting of the active reels on the display screen 802 can be characterized as a camera view (from the perspective of the player, of the active reels overlaid on the background graphic 806) panning to the left in FIGS. 8*d*-8*g*. Throughout the shifting operations in FIGS. 8*d*-8*g*, the active reels (at least the ones visible on the display screen) continue to spin.

Figure 8H:
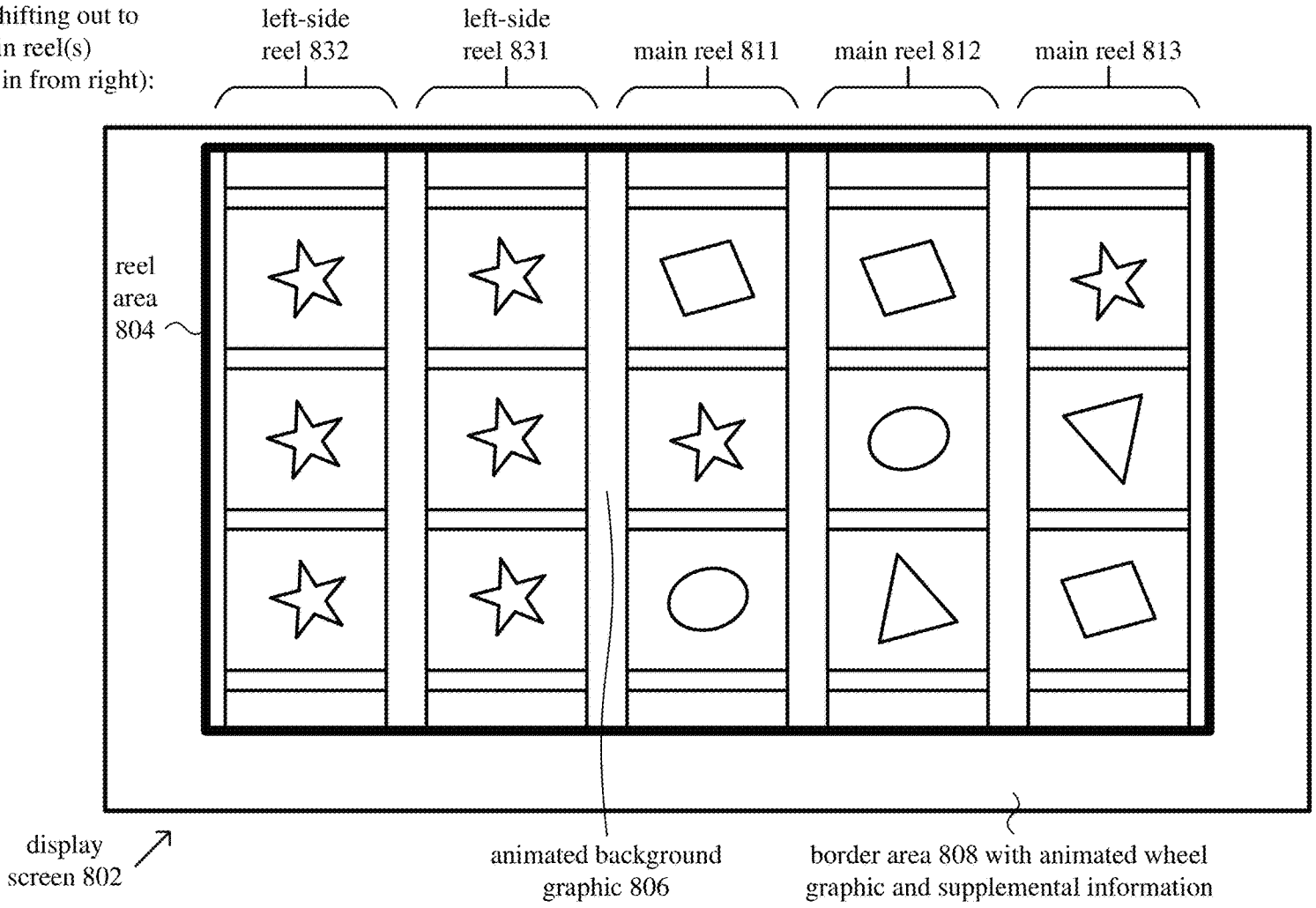
Figure 8I:
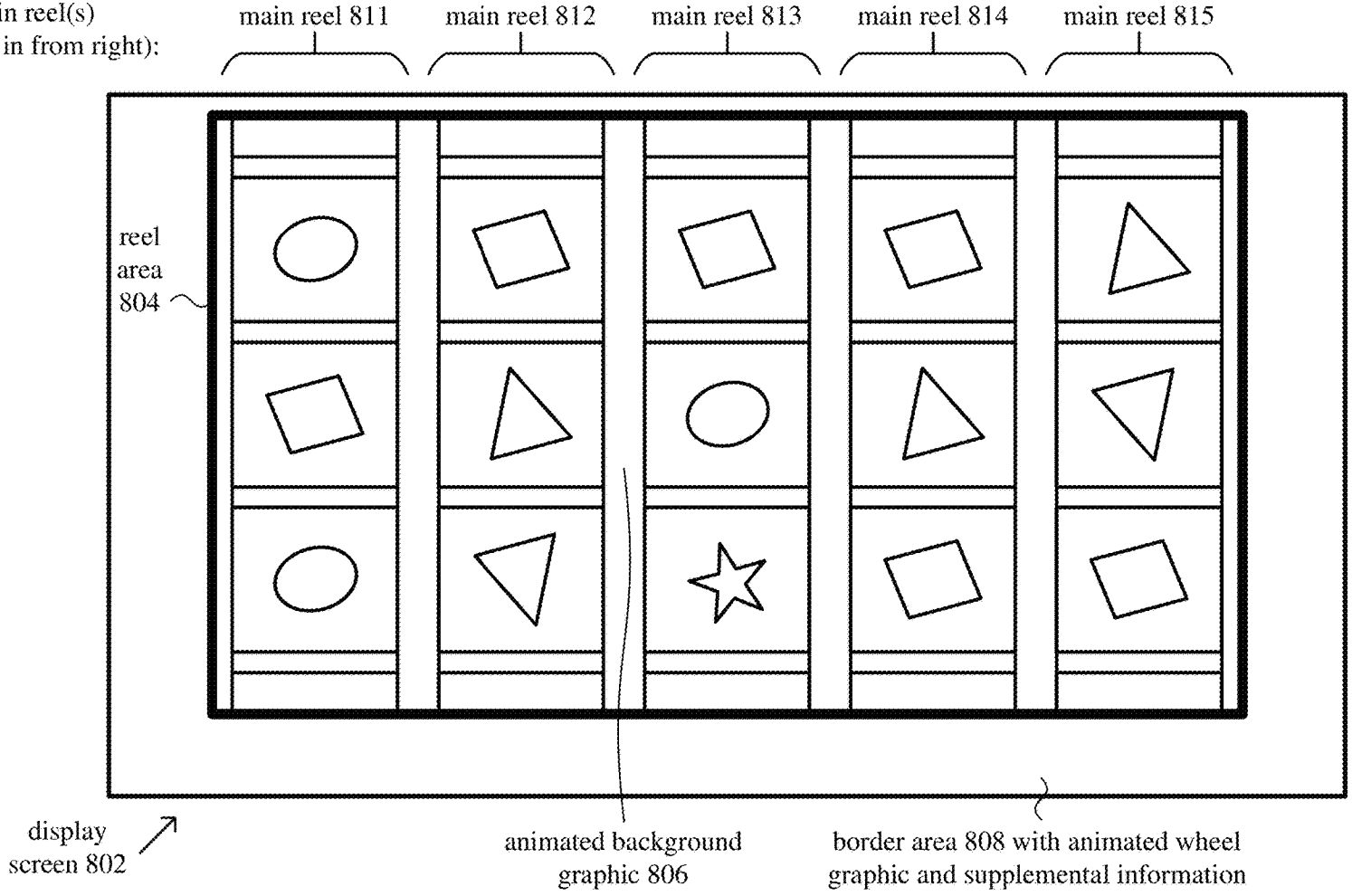
Figure 8J:
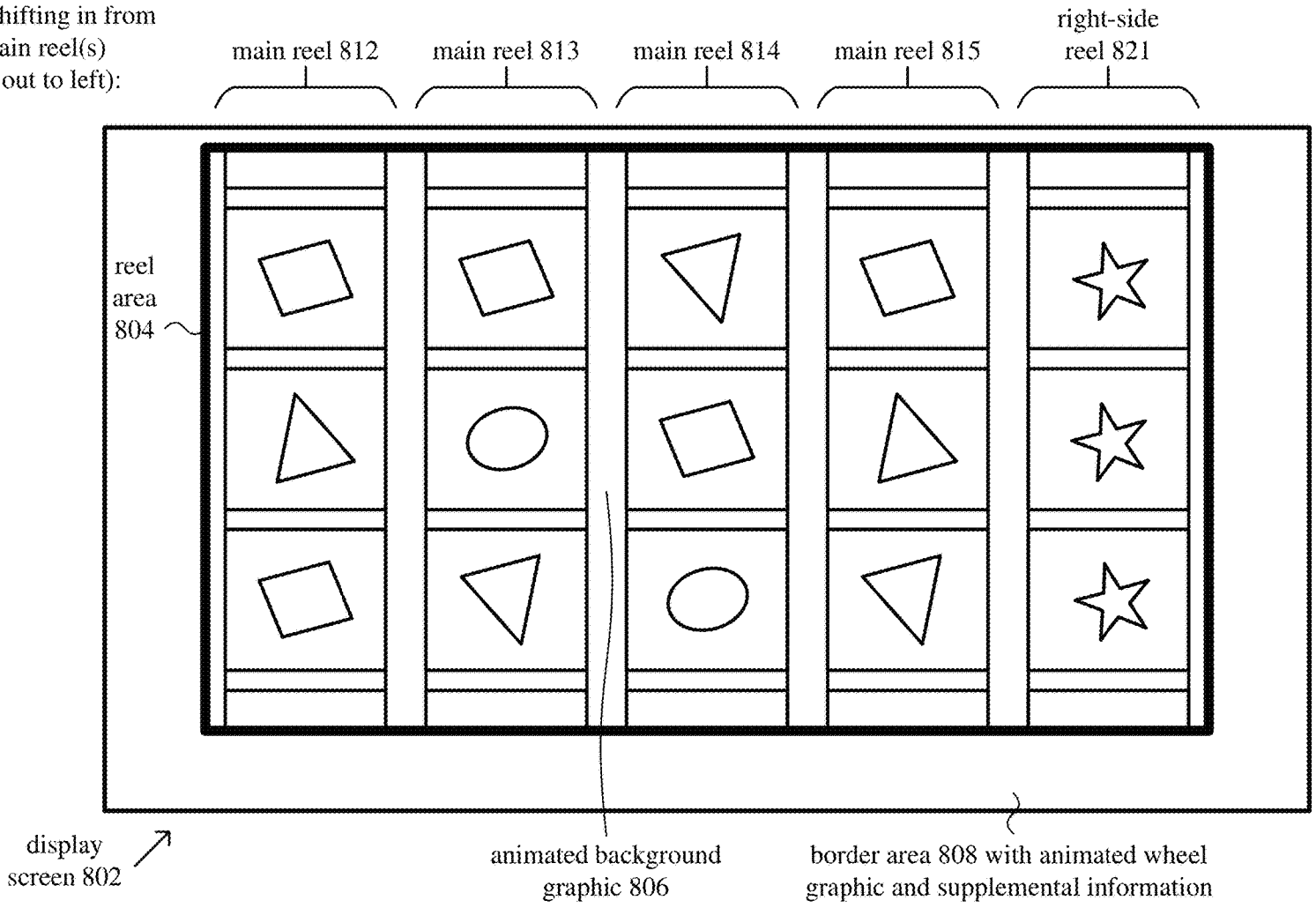

From FIGS. 8*h*-8*j*, the active reels gradually shift back to the left on the display screen 802. In FIG. 8*h*, a main reel 813 that was "off screen" to the right of the reel area 804 in FIG. 8*g* has shifted into the reel area 804, and a left-side reel 833 from the reel area 804 in FIG. 8*g* has shifted "off screen" to the left of the reel area 804. In successive figures from FIGS. 8*h*-8*j*, the three left-side reels 831-833 and main reel 811 gradually shift out of the reel area 804, and three other main reels 813-815 and one right-side reel 821 gradually shift into the reel area 804. At the extent shown in FIG. 8*j*, the reel area 804 encloses four main reels 812-815 and one right-side reel 821. From FIGS. 8*h*-8*j*, the background graphic 806 can shift sideways (panning to the right), so as to emphasize the direction of the shifting of the active reels, and the animated steering wheel graphic can spin. The shifting of the active reels on the display screen 802 can be characterized as a camera view (from the perspective of the player, of the active reels overlaid on the background graphic 806) panning to the right in FIGS. 8*h*-8*j*. Throughout the shifting operations, the active reels (at least the ones visible on the display screen) continue to spin.

Figure 8K:
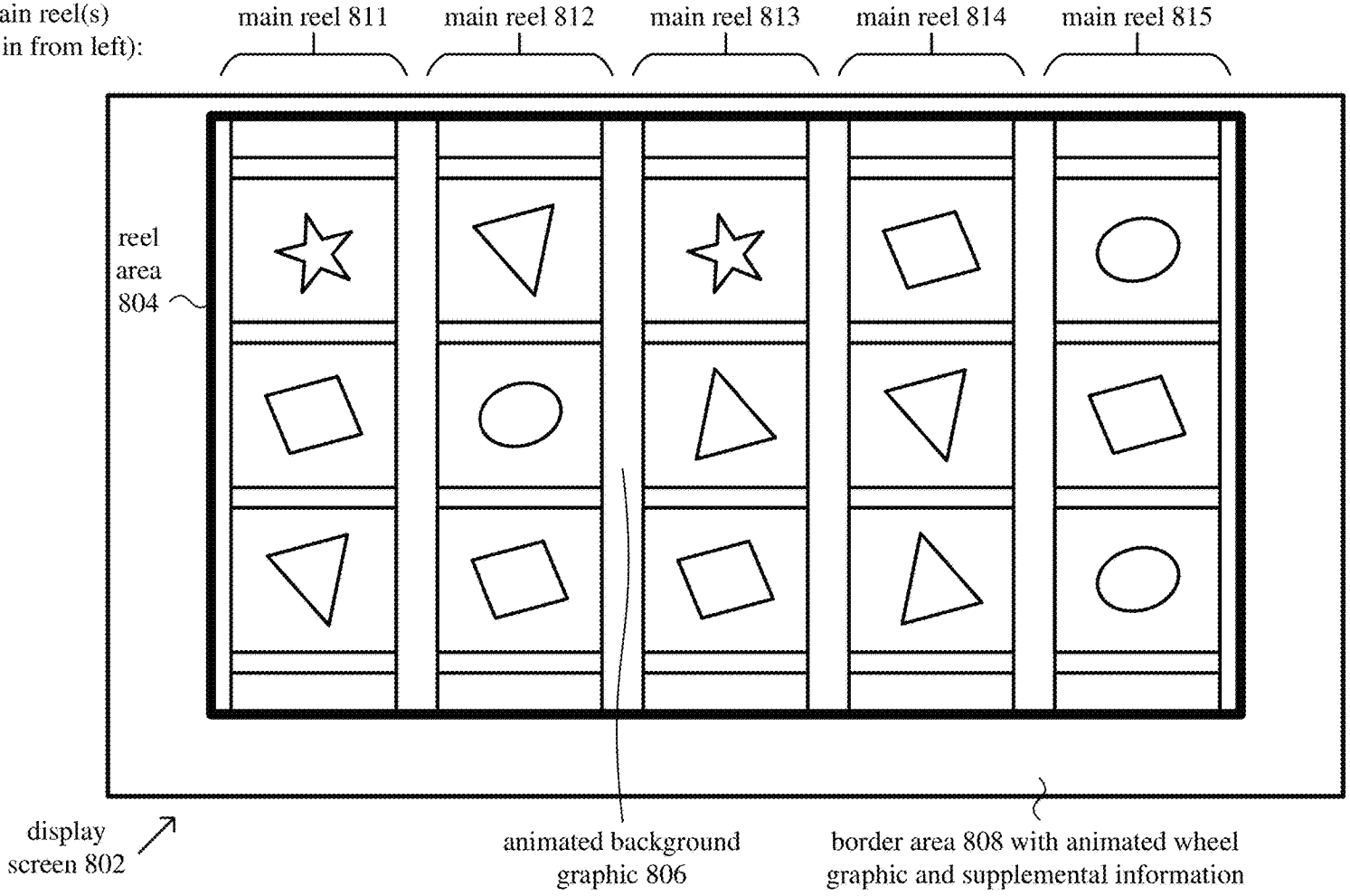
Figure 81:
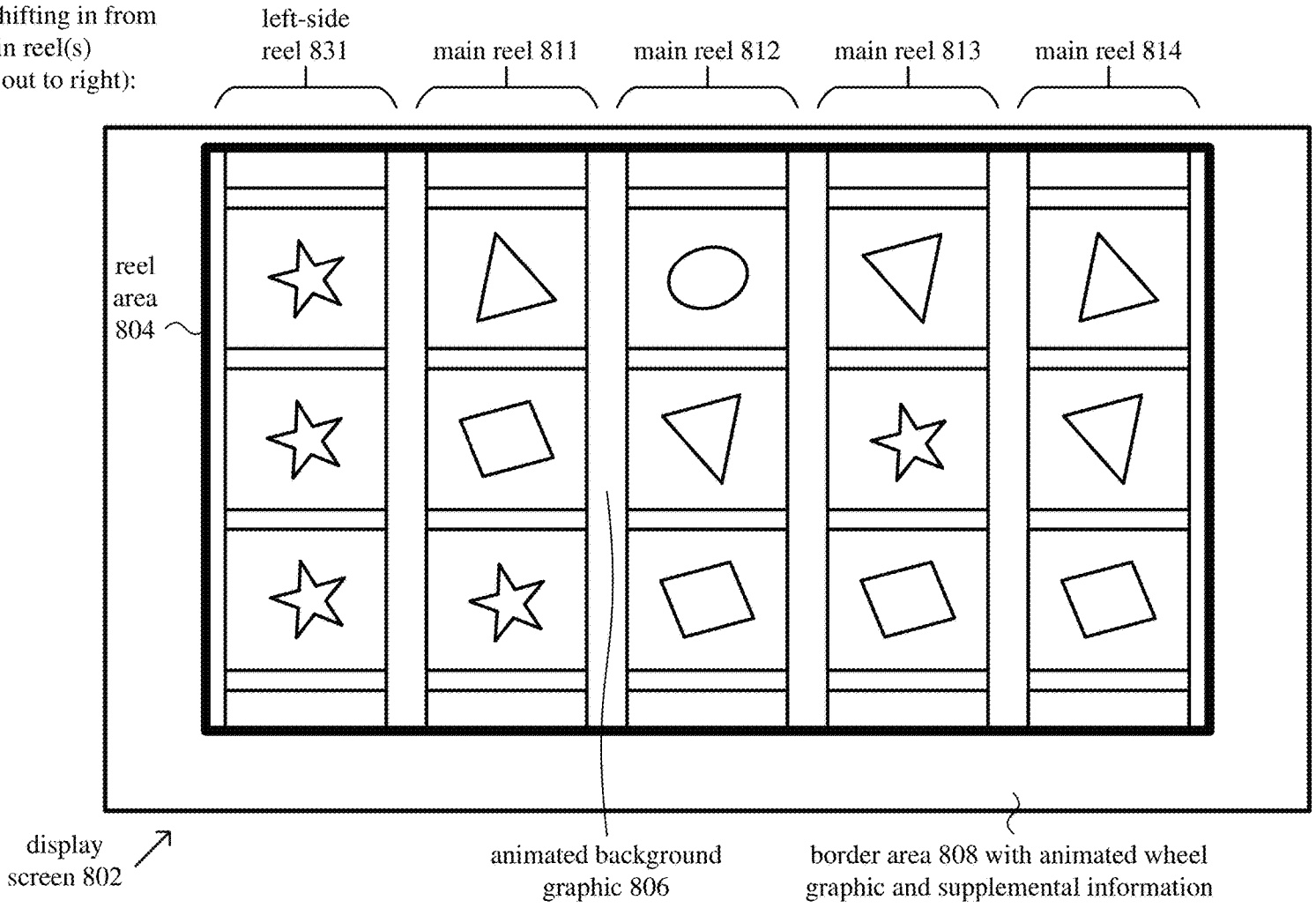

From FIGS. 8*k*-8*l*, the active reels gradually shift back to the right on the display screen 802. In FIG. 8*k*, a main reel 811 that was "off screen" to the left of the reel area 804 in FIG. 8*j* has shifted into the reel area 804, and a right-side reel 821 from the reel area 804 in FIG. 8*j* has shifted "off screen" to the right of the reel area 804. In successive figures from FIGS. 8*k*-8*l*, one right-side reel 821 and one main reel 815 gradually shift out of the reel area 804, and another main reel 811 and one left-side reel 831 gradually shift into the reel area 804. At the furthest extent shown in FIG. 8*l*, the reel area 804 encloses one left-side reel 831 and four main reels 811-814. From FIGS. 8*k*-8*l*, the background graphic can also shift sideways (panning to the left), so as to emphasize the direction of the shifting of the active reels, and the animated steering wheel graphic can spin. The shifting of the active reels on the display screen 802 can be characterized as a camera view (from the perspective of the player, of the active reels overlaid on the background graphic 806) panning to the left in FIGS. 8*k*-8*l*. Throughout the shifting operations in FIGS. 8*k*-8*l*, the active reels (at least the ones visible on the display screen) continue to spin. Thus, in the example shown in FIGS. 8*a*-8*l*, the subset of active reels that is selected (at the final landing position/final shift amount for the reels in reel shifting operations) is one left-side reel 831 and four main reels 811-814, which are adjacent to each other.

The timing of the reel shifting operations depends on implementation. For example, each iteration of the reel shifting of the active reels can take 1-2 seconds to render on the display screen 802, from one side to the other. Alternatively, the reel shifting of the active reels can take more time or less time. The rate of the reel shifting operations is typically non-uniform. For example, after the start of rendering operations for an iteration of reel shifting, the rate accelerates from zero to a top rate, then holds at the top rate for some duration, and then decelerates from the top rate to zero towards the end of the iteration of reel shifting. In this way, the rendering operations show the reel shifting of the active reels more smoothly, even when direction of the reel shifting changes.

In FIG. 8*l*, the one left-side reel 831 and four main reels 811-814 have successively landed (stopped) in the reel area 804. That is, the left-side reels 831 and four main reels 811-814 successively (from left-to-right across the reel area 804) stop spinning.

Figure 8M:
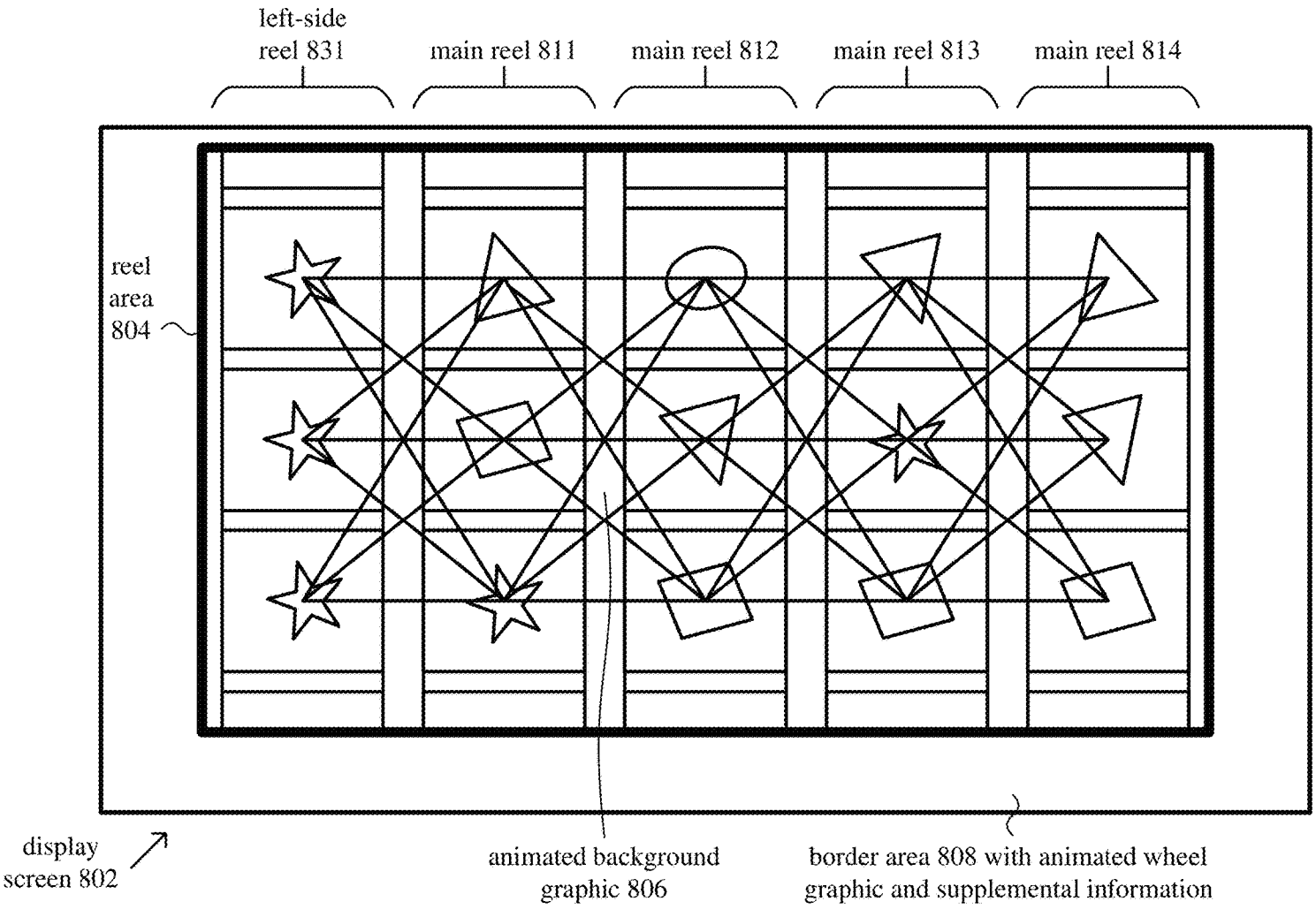

In FIG. 8*m*, win conditions on pay lines through the symbols shown in the reel area 804 are calculated. The pay lines can be successively rendered across the reel area, with a win total being incremented according to which win conditions are satisfied as the pay lines are added.

One of the side reels 821-823, 831-833 can be a column of wild symbols or a column of special symbols (character symbols). Or, one of the side reels 821-823, 831-833 can instead be a column of multiplier symbols (e.g., 2×, 3×, 4×). A side reel can also include a mix of symbols (e.g., a mix of wild symbols, special symbols, and/or multiplier symbols). The side reels are selected from a set of candidate reels, which, in general, include symbols of greater interest to a user due to their enhanced value when calculating win conditions on pay lines across the reel area 804.

Figure 9:
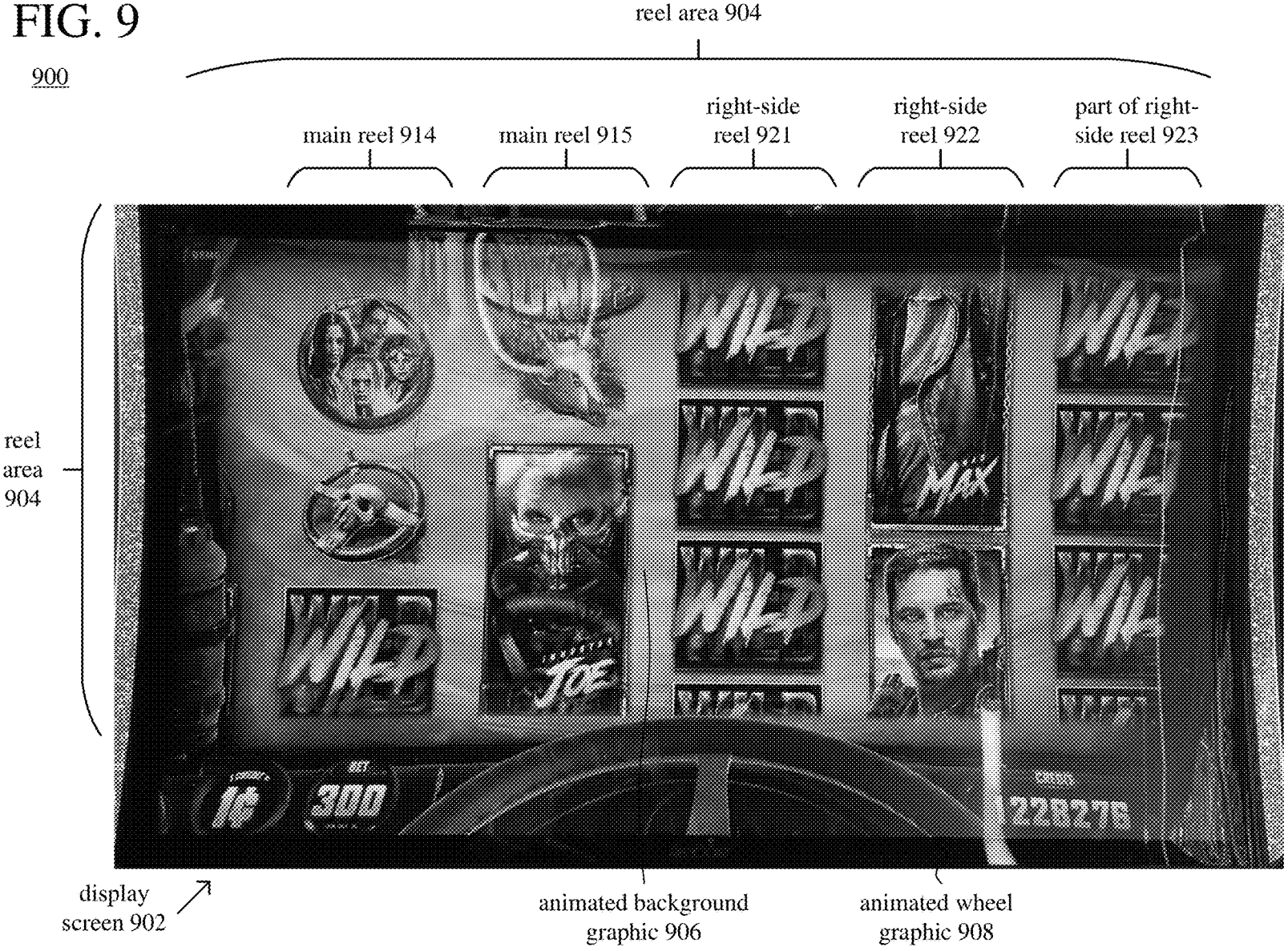
FIG. 9 is an example screenshot of a display screen of an EGM for a special mode of a base reel game, according to one example implementation.

FIG. 9 shows an example screenshot 900 of a display screen of an electronic gaming device such as an EGM for a special mode of a base reel game, according to one example implementation, in the middle of reel shifting and reel spinning operations. The example screenshot 900 includes graphical elements as described with reference to FIGS. 8*a*-8*m*. Specifically, the example screenshot 900 shows a reel area 904, animated background 906, and animated wheel graphic 908 on a display screen 902. The reel area 904 includes two main reels 914, 915 (other main reels have been shifted off screen to the left), two right-side reels 921, 922, and part of a third right-side reel 923.

VI. Alternatives and Variations.

Numerous embodiments are described in this disclosure, and are presented for illustrative purposes only. The described embodiments are not, and are not intended to be, limiting in any sense. The present disclosure is widely applicable to numerous embodiments, as is readily apparent from the disclosure. One of ordinary skill in the art will recognize that the innovations described herein may be practiced with various modifications and alterations, such as structural, logical, software, and electrical modifications. Although particular features of the innovations described herein may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the innovations described herein that must be present in all embodiments.

The Title (set forth at the beginning of the first page of this disclosure) is not to be taken as limiting in any way as the scope of the disclosed embodiments.

When an ordinal number (such as "first," "second," "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget." Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget"" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

When a single device, component, structure, or article is described herein, more than one device, component, structure or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component, structure, or article is described herein (whether or not they cooperate), a single device, component, structure, or article may alternatively be used in place of the more than one device, component, structure, or article that is described. For example, a plurality of computer-based devices may be substituted with a single computer-based device. Accordingly, the various functionality that is described as being possessed by more than one device, component, structure, or article may alternatively be possessed by a single device, component, structure, or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Further, the systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the innovations described herein. Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the innovations described herein, and does not imply that the illustrated process is preferred.

Although a process may be described as including a plurality of steps, that does not indicate that all or even any of the steps are essential or required. Various other embodiments within the scope of the present disclosure include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the present disclosure include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

For the sake of presentation, the detailed description uses terms like "determine" and "select" to describe computer operations in a computer system. These terms denote operations performed by a computer, and should not be confused with acts performed by a human being. The actual computer operations corresponding to these terms vary depending on implementation. For example, "determining" something can be performed in a variety of manners, and therefore the term "determining" (and like terms) can indicate calculating, computing, deriving, looking up (e.g., in a table, database or data structure), ascertaining, recognizing, and the like.

As used herein, the term "send" denotes any way of conveying information from one component to another component, and the term "receive" denotes any way of getting information at one component from another component. The two components can be part of the same computer system or different computer systems. The information can be passed by value (e.g., as a parameter of a message or function call) or passed by reference (e.g., in a buffer). Depending on context, the information can be communicated directly between the two components or be conveyed through one or more intermediate components. As used herein, the term "connected" denotes an operable communication link between two components, which can be part of the same computer system or different computer systems. The operable communication link can be a wired or wireless network connection, which can be direct or pass through one or more intermediate components (e.g., of a network). Communication among computers and devices may be encrypted to insure privacy and prevent fraud in any of a variety of ways well known in the art.

It will be readily apparent that the various methods and algorithms described herein may be implemented by, e.g., appropriately programmed general-purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium for performing the process. The apparatus that performs the process can include components and devices (e.g., a processor, input and output devices) appropriate to perform the process. A computer-readable medium can store program elements appropriate to perform the method.

The term "computer-readable medium" refers to any non-transitory storage or memory that may store computer-executable instructions or other data in a computer system and be read by a processor in the computer system. A computer-readable medium may take many forms, including but not limited to non-volatile storage or memory (such as optical or magnetic disk media, a solid-state drive, a flash drive, PROM, EPROM, and other persistent memory) and volatile memory (such as DRAM). The term "computer-readable media" excludes signals, waves, and wave forms or other intangible or transitory media that may nevertheless be readable by a computer.

The present disclosure provides, to one of ordinary skill in the art, an enabling description of several embodiments and/or innovations. Some of these embodiments and/or innovations may not be claimed in the present application, but may nevertheless be claimed in one or more continuing applications that claim the benefit of priority of the present application. Applicants may file additional applications to pursue patents for subject matter that has been disclosed and enabled but not claimed in the present application.

The foregoing description discloses only exemplary embodiments of the present disclosure. Modifications of the above disclosed apparatus and methods which fall within the scope of the present disclosure will be readily apparent to those of ordinary skill in the art. For example, although the examples discussed above are illustrated for a gaming market, embodiments of the present disclosure can be implemented for other markets. The gaming system environment of the examples is not intended to suggest any limitation as to the scope of use or functionality of any aspect of the disclosure.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A system comprising:

one or more processors;

memory; and control logic, implemented using the one or more processors and memory, configured to perform operations to control a user interface of an electronic gaming device, the operations comprising, for a game instance:

spinning at least some of a set of active reels on a display screen of the electronic gaming device, each of the active reels having an associated reel strip that is movable through a reel area on the display screen of the electronic gaming device upon a spin of the reel, wherein the active reels include one or more main reels and one or more side reels;

shifting at least some of the active reels into the reel area while shifting at least some of the active reels out of the reel area, before stopping at a subset of the active reels, wherein the shifting changes shift direction at least one time during the game instance before the stopping and the shift direction is based at least in part on user input; and after the stopping at the subset of the active reels, outputting an indication of an outcome.

2. The system of claim 1, wherein the one or more side reels include:

one or more first side reels on a first side of the one or more main reels; and one or more second side reels on a second side of the one or more main reels, the second side being opposite the first side.

3. The system of claim 1, wherein the one or more main reels are retained from a base process, and wherein the one or more side reels are selected, for a mode of the base process for the game instance, from a set of candidate reels, the set of candidate reels including:

one or more reels of wild symbols;

one or more reels of special symbols;

one or more reels of multiplier symbols; and/or one or more reels that include a mixture of wild symbols, special symbols, and/or multiplier symbols.

4. The system of claim 1, wherein the spinning:

is initiated in response to actuation of a button of the electronic gaming device; and stops for successive reels visible in the reel area.

5. The system of claim 1, wherein the spinning includes, for each of the at least some of the set of the active reels:

moving the reel strip of the reel through the reel area on the display screen while the reel is at least partially visible on the display screen.

6. The system of claim 1, wherein:

the shifting happens during the spinning;

the shifting happens before the spinning starts; and/or the shifting happens after the spinning stops.

7. The system of claim 1, wherein the shifting:

reaches each end of the set of active reels on the display screen at least one time.

8. The system of claim 1, wherein the shifting includes:

in each of multiple iterations:

determine a shift amount and a shift direction for the iteration; and shifting the active reels in the shift direction, to the extent of the shift amount, for the iteration, whereby at least some of the active reels are shifted into the reel area and at least some of the active reels are shifted out of the reel area; and after the multiple iterations, stopping the shifting at the subset of active reels.

9. The system of claim 1, wherein the operations further comprise:

during the shifting, rendering one or more animations that indicate direction of the shifting, wherein the one or more animations include:

a background animation behind the active reels;

a steering wheel adjacent the reel area.

10. The system of claim 1, wherein the display screen is a main display screen, and wherein the outputting the indication of the outcome includes rendering a graphic that indicates the outcome on the main display screen or a secondary display screen of the electronic gaming device.

11. A system comprising:

one or more processors;

memory; and control logic, implemented using the one or more processors and memory, configured to perform operations to control a user interface of an electronic gaming device, the operations comprising:

selecting a set of active reels for a mode that includes spinning at least some of the set of active reels on a display screen of the electronic gaming device, each of the active reels having an associated reel strip that is movable through a reel area on the display screen of the electronic gaming device upon a spin of the reel, the active reels including one or more main reels and one or more side reels;

selecting a subset of the active reels for the mode, including, for a game instance, determining a final shift amount and final shift direction of the active reels away from an initial reel position, the mode further including shifting at least some of the active reels into the reel area while shifting at least some of the active reels out of the reel area during the game instance, before stopping at the subset of the active reels shifted in the final shift amount and the final shift direction during the game instance, wherein the selecting the subset of active reels further includes:

generating a random number with a random number generator; and using a weighted table to determine the subset of active reels based at least in part on the random number, the weighted table including multiple entries, each of the multiple entries indicating an option for the subset of active reels; and determining an outcome of the mode.

12. The system of claim 11, wherein the weighted table with entries indicating options for the subset of active reels is a first weighted table, and wherein the operations further comprise:

starting the mode in response to a start condition, wherein the start condition is a random event whose occurrence is indicated by generating a random number with a random number generator and evaluating the random number against entries in a second weighted table, at least one of the entries in the second weighted table indicating the start condition.

13. The system of claim 11, wherein the selecting the set of active reels includes:

selecting the one or more side reels on a reel-by-reel basis; or selecting the one or more side reels from pre-defined groups of side reels.

14. The system of claim 11, wherein the weighted table with entries indicating options for the subset of active reels is a first weighted table, and wherein the selecting the set of active reels includes:

generating a random number with a random number generator; and using a second weighted table to determine the one or more side reels based at least in part on the random number, the second weighted table including multiple entries, each of the multiple entries indicating an option for a pre-defined group of side reels.

15. The system of claim 11, wherein the weighted table with entries indicating options for the subset of active reels is a first weighted table, and wherein:

the operations further include, for each reel of the subset of active reels:

generating another random number with the random number generator; and using a second weighted table to determine a symbol stop position for that reel based at least in part on the other random number, the second weighted table including multiple entries that indicate symbol stop positions.

16. The system of claim 11, wherein the selecting the set of active reels and the selecting the subset of active reels are performed concurrently using the weighted table as a single weighted table.

17. The system of claim 11, wherein the operations further comprise:

for each of multiple iterations of the shifting, determining a shift amount and shift direction, wherein for the iteration the shifting includes shifting the active reels in the shift direction for the iteration, to the extent of the shift amount for the iteration, and wherein the final shift amount and the final shift direction are the shift amount and the shift direction for a final iteration of the multiple iterations.

18. The system of claim 11, wherein the system is the electronic gaming device or an electronic gaming server, the computer system further comprising one or more of:

a cabinet;

a display screen;

one or more input buttons;

a credit input device; and a network interface configured to facilitate communication between the electronic gaming server and the electronic gaming device.

19. A method of controlling a user interface of an electronic gaming device, the method comprising:

selecting a set of active reels for a process, each of the active reels having an associated reel strip that is movable through a reel area on a display screen of the electronic gaming device upon a spin of the reel, the active reels including one or more main reels and one or more side reels;

spinning, for a game instance, at least some of the set of the active reels on the display screen;

selecting a subset of the active reels, the subset of the active reels including at least one of the one or more side reels;

shifting at least some of the set of the active reels into the reel area while shifting at least some of the active reels out of the reel area, before stopping at the subset of the active reels, wherein the shifting changes shift direction at least one time during the game instance before the stopping and the shift direction is based at least in part on user input;

determining an outcome of the game instance; and outputting an indication of the outcome of the game instance.

20. The method of claim 19, wherein the one or more side reels include:

one or more first side reels on a first side of the one or more main reels; and one or more second side reels on a second side of the one or more main reels, the second side being opposite the first side.

* * * * *